US005879278A

United States Patent [19]

Cox

[11] Patent Number: 5,879,278

[45] Date of Patent: Mar. 9, 1999

[54] METHOD AND MACHINE FOR CUTTING LINERS AND INSERTING CUT LINERS INTO CLOSURES

[75] Inventor: William A. Cox, West Bloomfield, Mich.

[73] Assignee: Atlantic Commerce Properties, Southfield, Mich.

[21] Appl. No.: 714,474

[22] Filed: Sep. 16, 1996

[51] Int. Cl.[6] ..... B31B 1/14

[52] U.S. Cl. ..... 493/67; 493/344; 493/365; 83/36; 83/37; 83/346; 29/412

[58] Field of Search ..... 29/412; 493/64, 493/67, 93–95, 344, 364, 365, 370, 388; 83/35, 36, 37, 346, 367

[56] References Cited

U.S. PATENT DOCUMENTS

| | | | |
|---|---|---|---|
| 1,469,757 | 10/1923 | Sibley | 83/35 |
| 3,279,290 | 10/1966 | Stemmler | 83/35 X |
| 4,306,849 | 12/1981 | Cress et al. | 493/67 X |
| 4,846,774 | 7/1989 | Bell | 493/344 X |
| 5,417,132 | 5/1995 | Cox et al. | 83/116 |

FOREIGN PATENT DOCUMENTS

| | | |
|---|---|---|
| 1511047 | 9/1969 | Germany . |

*Primary Examiner*—S. Thomas Hughes

*Attorney, Agent, or Firm*—Barnes, Kisselle, Raisch, Choate, Whittemore & Hulbert, P.C.

[57] ABSTRACT

Method and apparatus for repetitively making products, such as cap liners continuously from web material. A rotary knife drum having an array of die cutters cooperates with a counter-rotating anvil to thereby define a convergent web working zone therebetween. A pair of servo-motor driven nip feeders feed a web through the convergent work zone of the drum and anvil. Motor and belt drive means continuously unidirectionally rotates the knife drum and anvil at a constant angular velocity, while the web feeder cycles to first advance the web through the work zone such that travel speed and direction matches that of each die cutter as it passes through the work zone in the web travel path to thereby cut a cap liner from the web, quickly stops and then retracts the web a given pullback distance when each die cutter travels clear of the web travel path and before the next cutter enters the same, and then resumes quickly web advance to match travel of the next die cutter as it passes through the web travel path to thereby cut another cap liner. The pullback mode thereby forms a condensed rollout web working pattern of liner cut-outs in the web. An array of transfer posts on a transfer roll travel into and out of individual registry and sequentially with the die cutters to thereby pick off cut liners from the cutters for transport travel on the posts. An escapement supplies caps side-by-side and shifts them into alignment with successive transfer posts for transfer of cut liners successively into the caps.

20 Claims, 16 Drawing Sheets

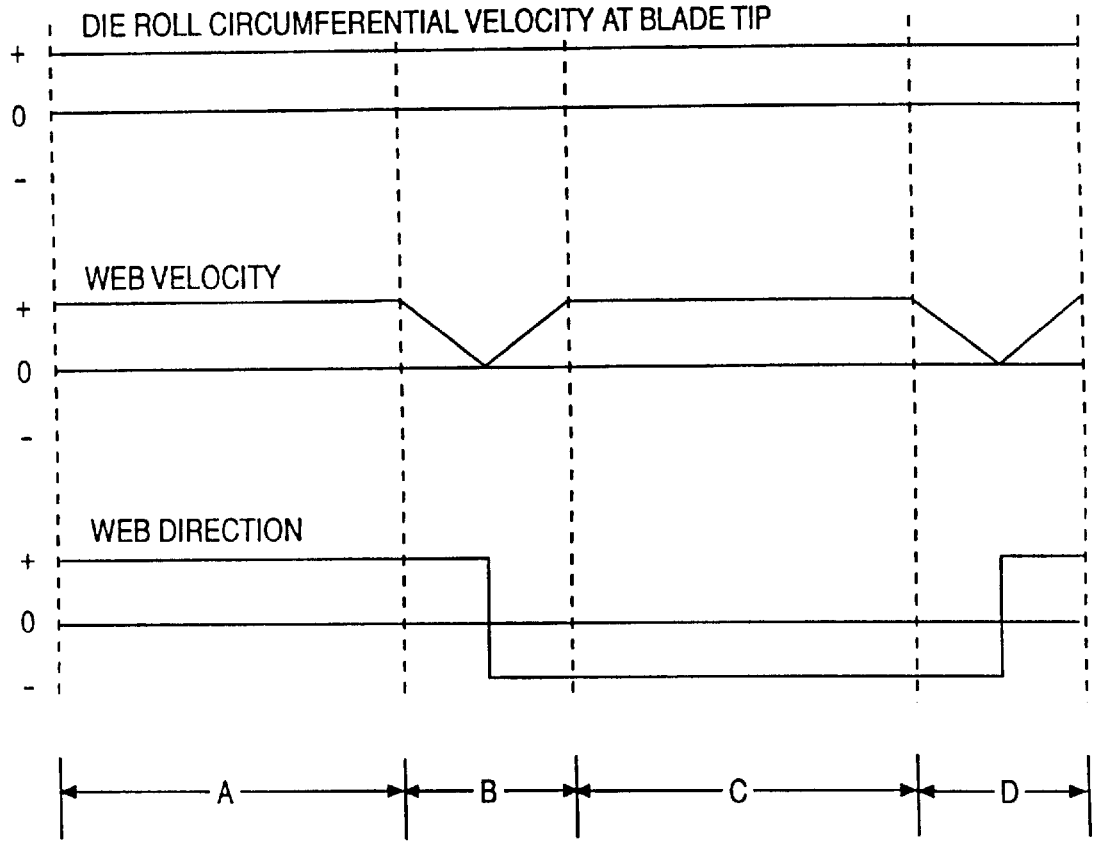

DESCRIPTION:

A = PORTION OF TIME WHEN PART IS BEING CUT. CONSTANT VELOCITY OF WEB IN FORWARD DIRECTION MATCHING VELOCITY OF BLADE ON DIE.

B = AFTER BLADE TIP CLEARS CUT PART, WEB DECELERATES TO ZERO VELOCITY, REVERSES DIRECTION AND ACCELERATES TO A CONSTANT VELOCITY IN THE NEW DIRECTION.

C = WEB PULLS BACK A SPECIFIED DISTANCE. VELOCITY MAY OR MAY NOT BE THE SAME AS THAT DURING CUT.

D = WEB DECELERATES, REVERSES AGAIN (NOW BACK TO FORWARD MOTION), AND ACCELERATES TO MATCH CIRCUMFERENTIAL VELOCITY OF DIE ROLL AT BLADE TIP.

FIG.24A

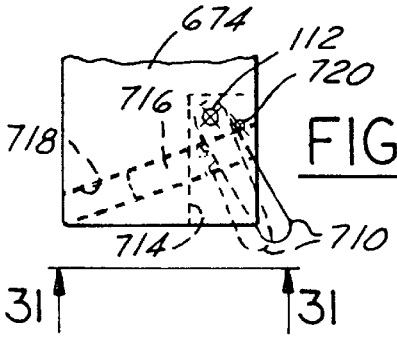
FIG.30
FIG.31
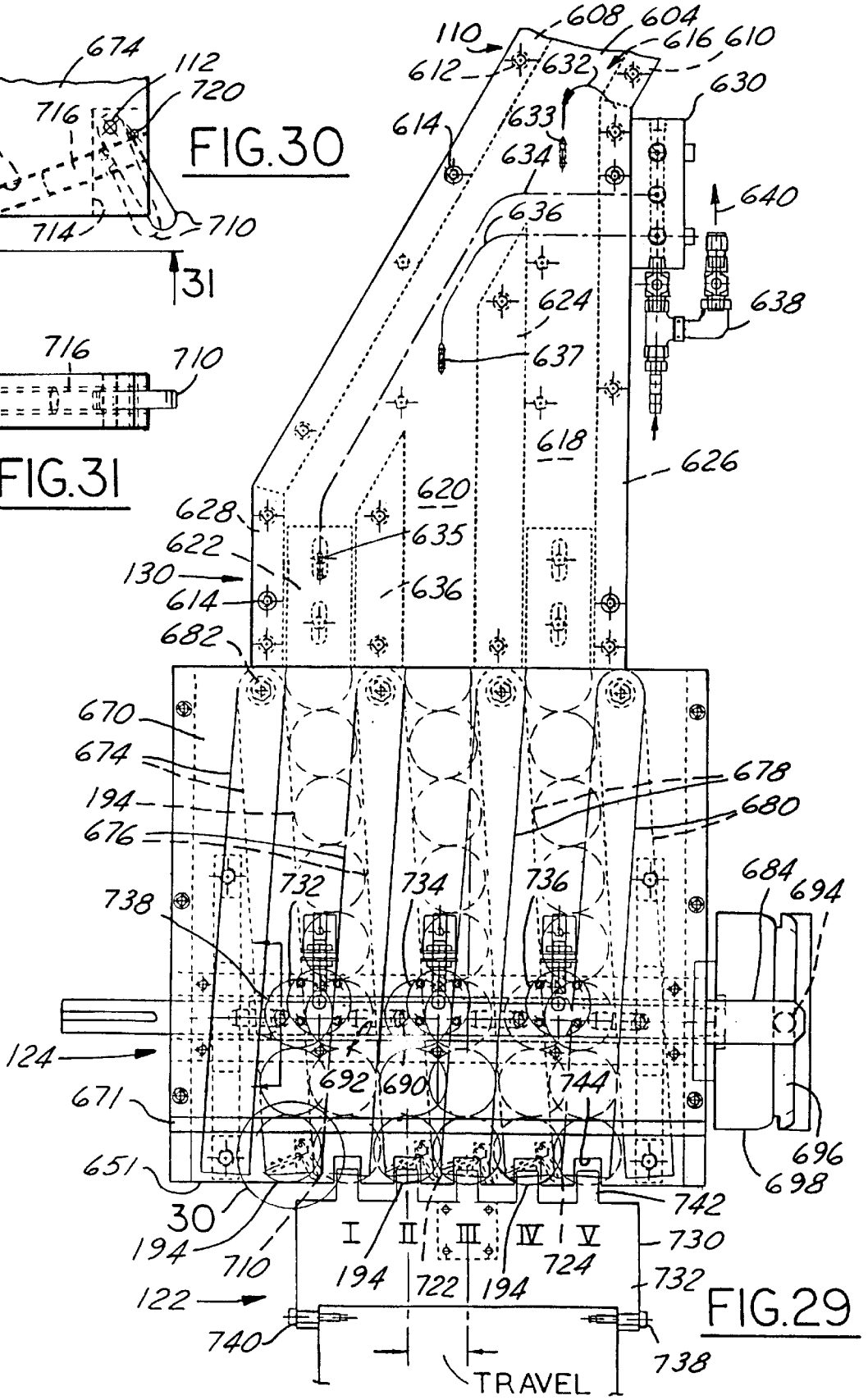
FIG.29

METHOD AND MACHINE FOR CUTTING LINERS AND INSERTING CUT LINERS INTO CLOSURES

FIELD OF THE INVENTION

This invention relates to processing of blanks from thin sheets or webs of materials such as paper, paperboard, cardboard, plastic film, metal foil, sheet metal and the like by passing the web between counter rotating rotary dies. More particularly, this invention relates to rotary die cutting of liners for closures from such a web of sheet material and inserting the cut liner into an associated closure in a rapid, continuous and automatic manner.

BACKGROUND OF THE INVENTION

There are many forms of packaging which require the use of screw caps or closures. Many of these closures require the insertion of a liner in order to obtain proper performance with the final package. These liners are used for various purposes. Some examples are: liquid tight seals, hermetic seals for product protection and seals providing tamper evidence. The liners are generally round in shape, although some may have protrusions for pull tabs or tabs which lock the liner into the closure. Liner materials can vary as well. They can be made of various laminations or of a single material. Some examples are: laminated boardstock, plastic foam, foil and foil laminates.

The machines which cut and insert these liners have usually been of the intermittent motion type. Generally, the caps are lined up beneath the liner material and the liner is punched out of the web and down into the closure. The next set of closures is then indexed into position while the punch retracts and the liner web is indexed forward. Where multiple liners are to be cut from a web, the punches are lined up at an angle to the web, thus maximizing the material usage. While these machines are not complex and do provide good material usage, they do have shortcomings. Because they are based on intermittent motion principles, they have speed limitations. Also, they incorporate precision punch and die systems which require very accurate setup and adjustment. In addition, they require a lot of time to set up when changing from one closure size to another. Further, because of their speed limitations, they cannot exactly match the output of the molding machines which produce the caps or closures. Thus, these machines require a separate department for operation. Caps from the molding machine must be put into intermediate containers, moved to storage, stored, moved to the liner department, emptied, sorted, lined, inspected, placed into the final shipping container and moved to the shipping area. Work in process and inventories can be quite expensive. Also, the floorspace and staffing required for a separate department add cost to the final product.

It is generally visualized that what might solve these problems is to develop a small, high speed, quick change, rotary motion machine to install directly at the closure molding machine; a machine that could both rotary die cut and then insert liners into associated closures, such as screw caps, immediately after closure molding and just prior to putting closures into a shipping container. This would eliminate the need for a separate department along with the associated handling and inventory management of closures waiting for liner inserts.

One previously known way of rotary cutting is to pass a web of material between a pair of superimposed rotating metal cylinders with one cylinder having a plain cylindrical surface acting as an anvil for cutting elements carried by the other cylinder. The cutting elements project generally radially outwardly from the body of the rotary die cylinder and have a sharp knife edge with a V-shaped cross section that penetrates the web and just lightly touches the anvil surface. Such rotary die cutters have been adapted to pick up the cut blanks and carry them on the cutters for "handoff" transfer to an associated inserter post carried on a rotary transfer roll. That post in turn carries the cut blank into registry with an associated closure disposed in a feed chute and then seats the liner in the closure.

However, for proper operation of such a rotary machine, there would need to be an array of liner pick-up transfer and inserter posts on a roll or other conveyor with a reasonable spacing of inserter posts so they can properly "pick" caps from the feed chute. However, in order to obtain maximum web utilization (i.e., minimize the scrap areas between liner cuts), the individual cutting dies would normally need to be spaced very closely together. In the past, to move from a closely spaced liner at the point of cut to a larger spacing at point of insertion would entail the use of "cut and slip" methods. This means there would be relative movement between the cut part and at least one of the rolls adjacent and along the path of travel of the cutter. The cut part would generally be held onto one roll at the initial spacing by vacuum. It would then be transferred to another roll at a different spacing by having the leading edge of the part pulled onto the second roll by stronger vacuum or a combination of vacuum on the second roll with positive pressure blow-off on the first roll. With the second roll traveling a bit faster than the first roll, the part would drag or "slip" on the first roll. This resulted in relatively inaccurate location on the second roll, especially for very small parts. Because of this inaccuracy, continuous rotary processing of small parts which require a variation in spacing from initial cut has heretofore been impossible.

OBJECTS OF THE INVENTION

Accordingly, objects of the present invention are to provide an improved method and improved machine for cutting liners from a web of liner material and inserting each liner into an associated closure which overcome the aforementioned problems and provide:

(1). the ability to process a web with only minimum scrap between cutouts, while maintaining a greater distance between cut parts throughout the process;

(2). elimination of any relative motion between the cut part and any of the processing rolls in the direction of roll rotation;

(3). the ability to cut and insert liners into molded closures at higher speeds, higher accuracy and with more styles of attachment than previously;

(4). higher speed and more reliable automatic processing through the use of continuous, constant velocity, rotary motion die cutting, transfer and liner-closure assembly mechanism improvements;

(5). lower material costs (less scrap);

(6). fewer change parts, lower cost of change parts and less time to change from one part (product) size to another;

(7). lower operating costs and maximum savings to the closure manufacturer;

(8). maximum flexibility to handle part sizes ranging from very small to very large on the same machine; and (9). maximum flexibility to handle various part configurations including circles and circles with projections for closure liners, and for other applications the ability to process many additional part configuration and shape options.

SUMMARY OF THE INVENTION

In general and by way of summary description and not by way of limitation, the present invention accomplishes the foregoing objects by providing an improved method and machine for repetitively making cap liners continuously from web liner material utilizing a rotary drum knife die having an array of web die cutters supported thereon for bodily travel in a rotary path about the rotational axis of the drum. A rotary anvil having a cylindrical web supporting surface moves in a path tangentially adjacent the path of travel of the die cutters and in their travel direction to thereby define a convergent web working zone therebetween. A pair of nip roll feeders driven by computer-controlled servo-motors feed a strip of the web liner material lengthwise linearly between the anvil supporting surface and the cutter travel path through the convergent work zone therebetween. The die cutters are mounted on the rotary carrier drum in a cylindrical pattern array with predetermined relatively wide spacing between individual cutters circumferentially of the drum array. If the web feed speed and direction were to continuously match that of the cutters in the web working zone, the cutter array would produce a corresponding linearly widely spaced first rollout web working pattern. However, the invention condenses the rollout pattern spacing longitudinally of the web while still continuously unidirectionally rotating the drum at a constant angular velocity. This is achieved by operating the web nip roll feeders in a web strip feed cycle that advances the strip in a linear in a first phase travel path through the work zone with an intermittent pullback mode such that travel speed and direction matches that of each die cutter as it passes through the work zone to thereby cause each die cutter to cut a cap liner in and from the web strip. Then, in a second phase, after a given die cutter travels clear of the web strip travel path and before the next successive die cutter enters the web strip travel path, the nip roll feeders retract the web strip a given pullback distance, less than that of the circumferential spacing distance between the given cutter and the next successive cutter on the die cutter. The nip feeders then resume advance of the web strip such that the strip travel speed and direction again matches that of such successive die cutter as it passes through the work zone and into the web travel path to thereby cause this next cutter to form a corresponding liner cut-out in and from the web. This feed cycle is repeated throughout the travel of the succeeding die cutters in the drum array through the work zone and web travel path during each revolution of the knife drum. This results in a condensed rollout pattern of liner cut-outs being formed in the web strip having cut-out spacing lengthwise of the web strip less than that of the die cutter circumferential spacing on the drum.

Preferably, the die cutters are arranged in the drum pattern array to form at least first and second lanes of the cutter extending circumferentially 360° in the cylindrical pattern array. The cutters are constructed and arranged in these lanes such that this rotary travel paths overlaps transversely and hence the rollout pattern of liner cut-outs in the web strip are arrayed internested and in corresponding first and second web lanes but without interference between individual cut-outs thereby produced in the web strip. In a preferred embodiment, there are five lanes of cutters arranged in circumferentially alternating cross-rows of two and three cutters to produce a corresponding but condensed internested five lane cut-out rollout pattern in the web strip.

Preferably, vacuum is applied to each cutter as it engages the web strip to thereby vacuum draw the associated web cut liner against the cutter as it is being severed from the web by the cutter to thereby assist in liner pick-off and transport on the cutter and away from the web travel path.

The vacuum is continuously maintained on the cutter after liner severance and pick-off onto the cutter and during transport travel of the liner on the cutter to a discharge station located remote from the web travel path. Then positive air pressure is applied to the cutter beneath the liner when it travels past the discharge station to blow the liner off from the cutter.

The machine also inserts cut liners individually into associated closure caps by providing a transfer roll conveyor having an array of transfer posts constructed and arranged in lanes corresponding to those of the cutters on the knife drum for travel into and out of individual sequential registry with the cutters in their travel lanes on the knife drum as they travel through the drum discharge station. The posts move at the same travel speed as the cutters, and each post has a liner pick-off receiving end operable for engaging the cut liner on the associated die cutter during such registry. A vacuum is applied to the transfer post receiver end to thereby draw-assist pick off the cut liner from the cutter and onto the post receiver for transport travel of the cut liner on the post to a transfer conveyor discharge station. An escapement cap feeder sorts out cut-liners respectively cut from the first and second web lanes by supplying and positioning side-by-side first and second closure caps with their open end facing the post travel path, and operating the escapement through a cycle in which the first cap is positioned initially in alignment with a transfer post traveling in the first lane when the first lane cut liner carried thereon enters the conveyor discharge station. The first lane cut liner from the first lane transfer post is inserted into the first cap during travel of the first lane transfer post therepast. Then the escapement shifts the caps in a shift path perpendicular to the travel path of the transfer posts to thereby position the second cap in alignment with a transfer post traveling in the second lane when the second lane cut liner thereon enters the conveyor discharge station. The second lane cut liner is then transferred from the second lane transfer post and inserted into the second cap during travel of the second lane post therepast. Then the escapement shifts back to bring another first lane cap into alignment with the first lane transfer post ready for the transfer of a cut liner from the next successive first lane post to thereby complete one of the sorting cycles.

Each cut liner is inserted into the associated cap as the cap is drawn slidably out from the escapement by the post engagement and then pushed slidably along a presser shoe assembly by the transfer post. When each cap/liner assembly has been carried by its post over a discharge conveyor, it is blown-off and spring ejected downwardly from the transfer post onto the discharge conveyor belt for out-feed from the machine via a discharge chute.

In the operation of machine of the invention, the knife roll, anvil, and web feeders cooperate to efficiently perform the cutting web pullback method of the invention to thereby optimize the number of liner cut-outs obtained from five lanes in the web. Yet this closely nested pattern of liner cutouts in the web is achieved without internesting the constant speed, continuous, unidirectional rotary motion of the knife roll, and likewise the anvil, as it sequentially presents alternating cross-rows of two and three cutting elements to the web as the web passes between the knife roll and anvil. The web pullback concept takes advantage of the desirable wide clearance space made available in the non-contact zone between successive cross-rows of die elements that allows the web advance to be halted and then the web pulled back the appropriate predetermined distance if such feed reversal is performed rapidly. The rapid, precise and efficient web feed provided by the computer controlled, servo-motor-driven nip roll feeder enables the web to be quickly fed forward, stopped quickly, reverse fed (pullback) and then quickly advanced again in accurate timed relation to match the web speed to that of the next cross-row set of die elements as they engage the web to make the next nested set of liner cut-outs from the web.

As the cutting elements penetrate the web to cut-out the cap liners in the nested cut-out web rollout pattern the cut liner is engaged within the confines of the knife edge of the cutter and sucked inwardly by suction applied through die element ports from a manifold vacuum supply and timing system of the knife drum. As each cross-row of die elements reach tangency in their travel path with the travel path of the corresponding cross-row of transfer posts at a drum die cutter discharge station, a positive pressure is precisely applied to the interior of the cutting die in conjunction with the negative pressure precisely applied to the upper end of the meeting transfer post by cooperation of a manifold timing system of the transfer post roll conveyor with the drum manifold. This insures rapid, accurate and non-circumferential-slip transfer of each cut liner from each cutting die securely onto the upper end seat of the associated transfer post.

In addition, a compound spring-biased telescopic motion of a transfer post sleeve telescopically encircling an outer post of the transfer post assembly enables the outer pick-off end of the post to actually enter the confines of the circular-knife edge of the die cutter to effect a positive compression of a post quad seal against the cut liner as vacuum is being applied to the surface of the liner pressed against the post end seat. This combined penetrating and vacuum sucking action of the post, coupled with the positive die blow off exerted beneath the liner through the die posts ensures a secure, positive and arcuate placement of the cut liner onto the transfer post. The continued application of vacuum to the underside of the liner in the zone bounded by the post seal effects a strong clinging action of the liner onto the post so that the liner is reliably carried on the post in its travel from the knife drum die discharge station to a transfer roll conveyor discharge station. The post then begins to insert the carried cut liner into the inverted closure cap at the outlet of the escapement. Then subsequently during its convergent travel over the presser shoe the cap is temporarily installed on the post as the post assembles the liner fully into the cap.

During cap travel on the shoe the upper open edge of the closure engages a bevel of the post sleeve and forces it to retract against the force of springs. This action assists in centering the cap axially on the transfer post axis and likewise as to the associated cut liner being thereby inserted into the cap. The spring pressure in the compressible transfer post also mechanically assists insertion of the liner to the bottom of the closure. Vacuum is cut-off to the post once the closure reaches the presser shoe. Thus, the cut liner is inserted into the cap and is fully bottomed therein as the transfer post becomes fully inserted into the cap while the same slides along of the presser shoe. A concave presser shoe surface maintains proper spacing to achieve this mechanical squeeze pressure between post and shoe as the cap is thus held therebetween and slid along the presser shoe surface.

When the transfer post travels clear of the presser shoe, the compression restraint of the post springs is released, thereby causing the post sleeve to force the cap liner assembly off of the post and onto the upper run of a discharge conveyor belt. This transfer of the closure is assisted by a timed air pressure post blow-off action from the transfer roll manifold, as well as by a discharge conveyor vacuum draw system disposed under the conveyor belt upper run. All closures in each cross-row are dropped simultaneously onto the conveyor belt and then proceed well spaced in single file out through a conveyor inspection section into a discharge chute(unless blown side ways into one or the other of two reject chutes).

The "web pull back" concept of the invention makes it feasible to use faster, lower cost rotary processing for these type of parts. The cutting elements on the rotary drum die are located to exactly match the post spacing and lane alignment on the subsequent processing roll and escapement. Thus, all transfers are made positively and without relative motion (i.e., circumferential slip) between cut part and processing rolls. The web feed is accurately and automatically controlled by servo driven nip rolls positioned both before and after the cutting die. The drum cutting die is manufactured with a predetermined gap between one or more cutting elements mounted on the drum (i.e., an area where no cutting occurs and the web is not compressed between the cutting die(s) or between the die and anvil rolls.) Indeed, this gap enables wider circumferential spacing of die element(s) on the drum knife roll and thus facilitates die installation and removal for service and part processing changeover, as well as accommodating a greater variety of die configurations without crowding, and without thereby decreasing processing efficiency.

The method of feeding caps utilizes an improved side-to-side oscillating escapement assembly co-operable with an alternating transfer post layout design. This further allows maximum web utilization since a full row of posts would require excessive side spacing in order to allow for cap wall and guide thicknesses. The escapement can also be reversed in mode of operation to function as sorter or single file output condenser.

The invention employs continuous motion, constant velocity, rotary processing principles for all the part handing rolls, which is made possible by the unique "web pullback" feature of the invention so that web utilization is maximized. At the same time, cut liners are spaced properly onto inserter posts such that no "relative motion" (circumferential slip) is required between cutting and transfer rolls at any point. Stated differently, the unique "web pullback" design eliminates the need for "cut and slip" operations when transferring the cut part from one roll to another, and is compatible with a large range of cut part sizes. Because of the continuous rotary motion design, the machine runs at a faster rate with less maintenance and set-up cost than those of intermittent motion design. Thus, this one machine of the invention is now capable of handling the entire output of a single or multiple molding machine(s).

BRIEF DESCRIPTION OF THE DRAWINGS

The foregoing as well as other objects, features and advantages of the present invention will become apparent from the following detailed description of the presently preferred embodiments of the invention in accordance with the best mode presently known for making and using the same, the appended claims and the accompanying drawings (which are to engineering scale unless otherwise indicated) wherein:

FIGS. 24 and 24A are respectively a simplified diagrammatic timing sequence layout and an associated plot of web velocity versus travel and illustrating the sequence of motion of web feed in accordance with the method and operation of the machine of the invention FIGS. 20–23;

FIG. 29 is an enlarged fragmentary plan view of the diverter track subassembly and associated escapement subassembly of the closure feeding mechanism of the machine of FIG. 1;

FIG. 30 is an enlarged fragmentary plan view of one of the escapement stop fingers and spring subassemblies shown in the portion of FIG. 29 encompassed by the circle A therein; and FIG. 31 is an end view taken on the line 31—31 of FIG. 30;

GENERAL ORGANIZATION AND PRINCIPAL COMPONENTS OF MACHINE 100

Figure 1:
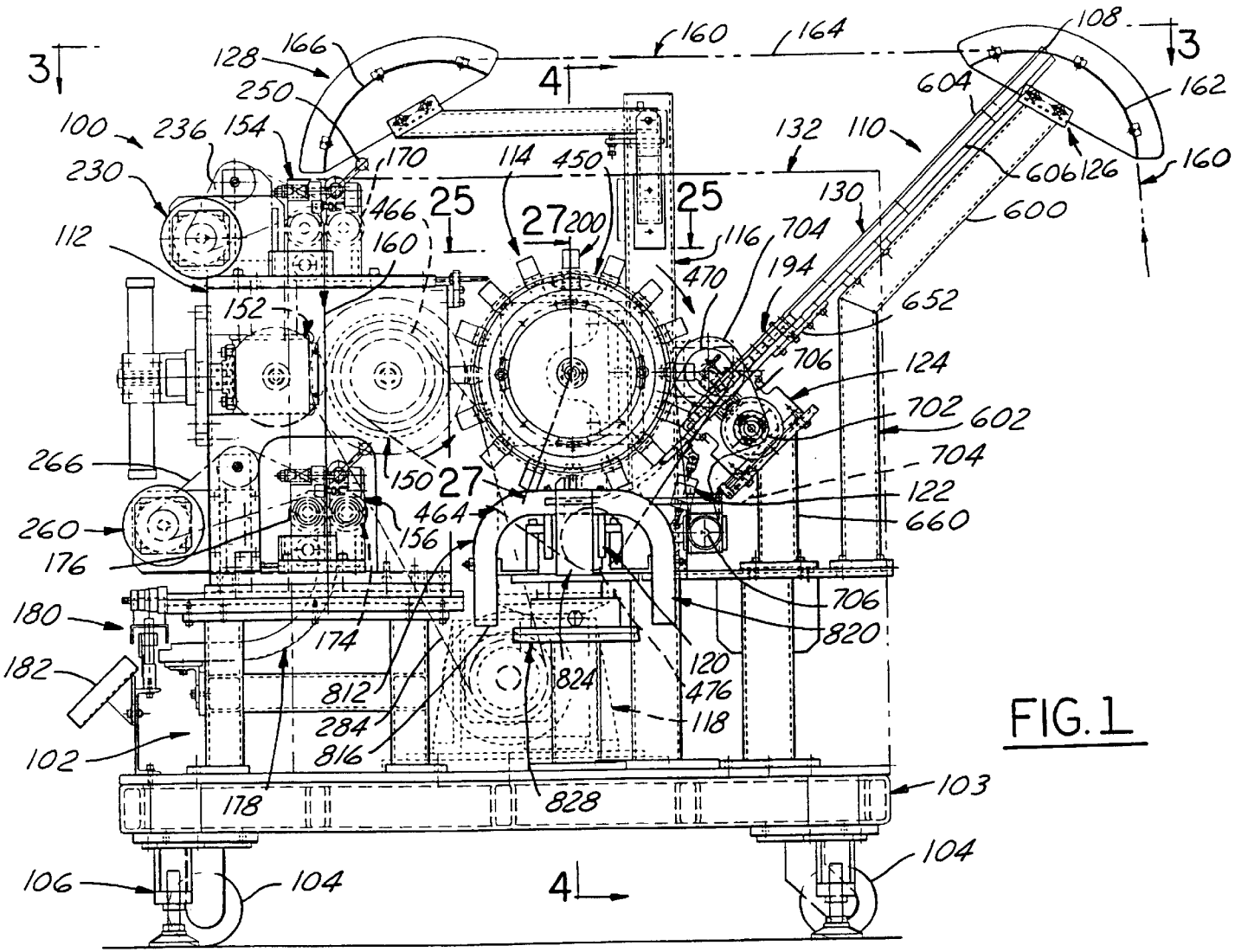
FIG. 1 is a side elevational view of one preferred but exemplary embodiment of an improved machine of the invention for practicing the method of the invention.

FIGS. 1–4 are reproductions of engineering scaled assembly drawings, illustrating a preferred but exemplary first embodiment of a machine 100 constructed in accordance with the invention and operable for practicing a first embodiment of the method of the invention. Machine 100 is preferably supported on a framework 102 mounted on a platform 103 provided with casters 104 and adjustable standoff feet 106 so that machine 100 can be readily moved and then stationarily supported adjacent the output of a high-speed plastic injection molding machine (not shown) supplying its output of screw cap closures to the inlet of a closure feeder track mechanism 110 of machine 100. Among the principal components of machine 100 shown in assembly in FIGS. 1–4 are a rotary knife and nip roll feed sub-assembly 112, (shown by itself in FIGS. 5, 6 and 7), a pick-off transfer post rotating drum sub-assembly 114 (shown separately in FIGS. 25–28), a mounting post and drive assembly 116, a main drive assembly 118, a discharge conveyor assembly 120, a presser shoe sub-assembly 122, a closure feed escapement assembly 124, upstream and downstream web in-feed guide sub-assemblies 126 and 128 and a closure end feed diverter track subassembly 130 located between track 110 and escapement mechanism 124.

Auxiliary components of machine 100 include a cabinet 132 mounted behind the machine on platform 103 for housing associated electrical and electronic components, and a rotary vane-type vacuum pump subassembly 134 with associated electric motor drive, release valves, vacuum gauge and vacuum hose and fittings (not shown).

The rotary knife and web feed sub-assembly 112 includes as primary components a rotary knife die 150, an anvil roll 152, an upper nip roll sub-assembly 154 and a lower nip roll sub-assembly 156, as best seen in FIGS. 1, 5, 6 and 7.

In the general operation of machine 100, as best seen in FIG. 1, a web 160 is taken from a suitable supply roll of liner web material (not shown) and led upwardly and slidably over the curved guiding apron 162 of upstream web guide assembly 126. Web 160 then feeds in an upper run 164 over the curved guide apron 166 of downstream web guide assembly 128. Web 160 then passes between the counter-rotating gripping surfaces of a pair of nip rolls 170 and 172 of upper nip roll assembly 154 which provide the tension force for draw feeding web 160 up to this point in its travel path. Counter rotating nip rolls 174 and 176 of lower nip roll assembly 156 then nip and draw web 160 downwardly for liner cut-out between the counter rotating rotary die 150 and anvil 152. Web 160 as so cut-processed is then fed into a discharge chute 178. The die cut web 160 then exits from chute 178 past a cutting mechanism 180 which severs the die cut web into small pieces which in turn drop onto an exit chute 182 for gravity discharge to a suitable scrap container (not shown).

Figure 15:
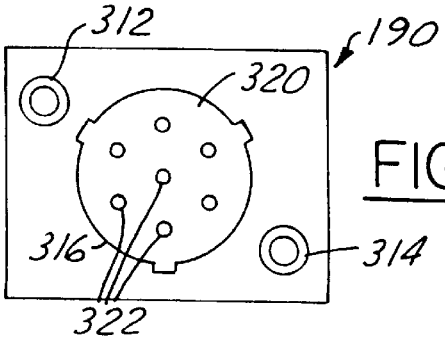
FIGS. 15, 16 and 17 are respectively an enlarged plan, end and side elevational views of one of the circular knife cutting die inserts shown by itself.
Figure 32:
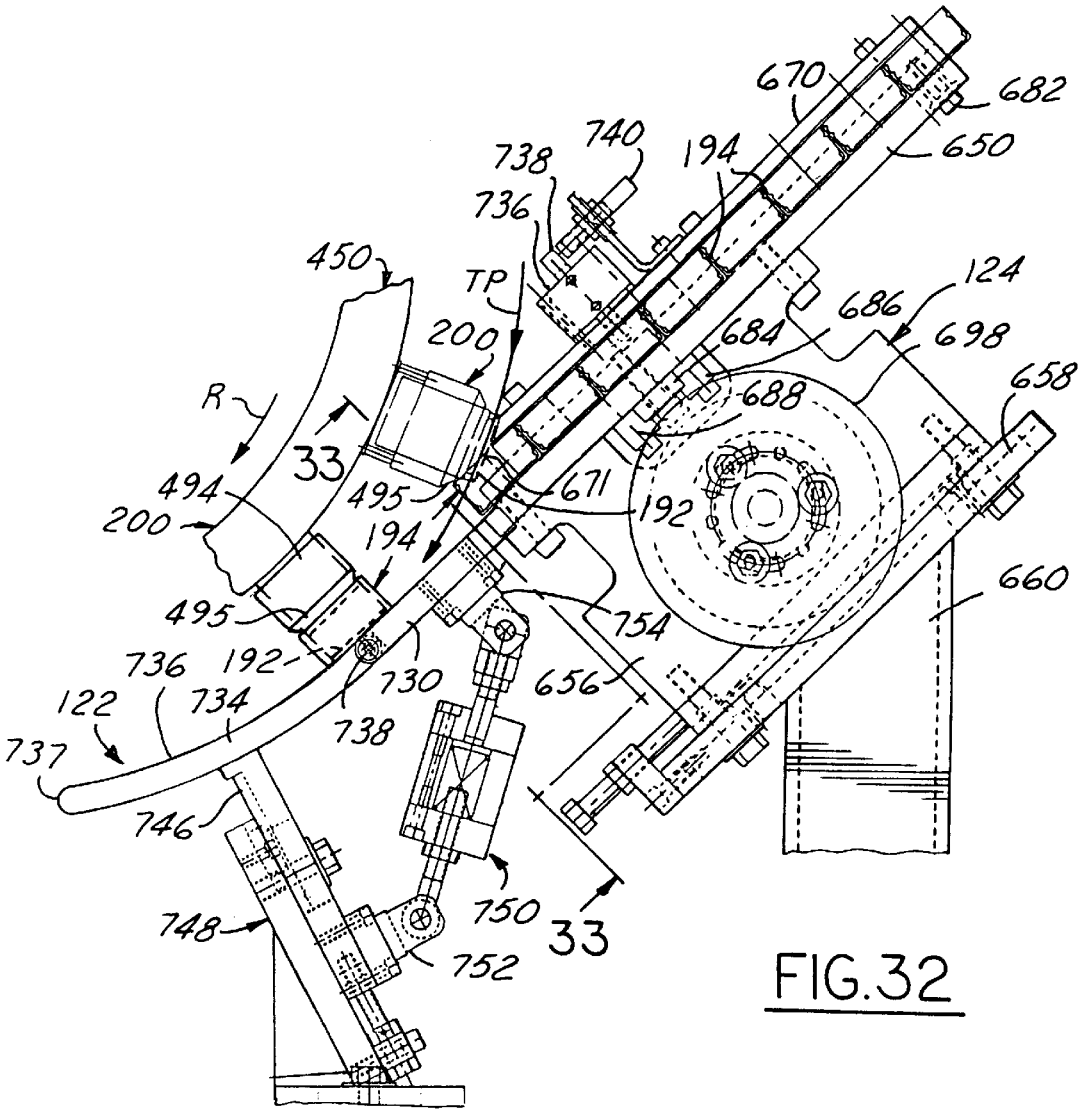
FIG. 32 is an enlarged fragmentary side elevational view of the presser shoe subassembly and escapement subassembly of the closure feed chute mechanism of the machine of FIG. 1.
Figure 34:
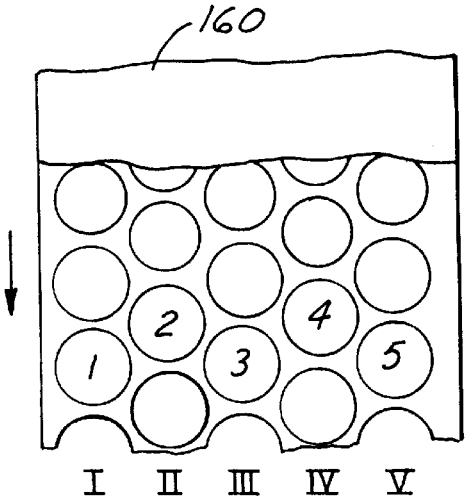
FIG. 34 is a fragmentary plan view of the liner web illustrating a portion thereof as completely die cut by the machine and a portion thereof prior to die cutting.
Figure 35:
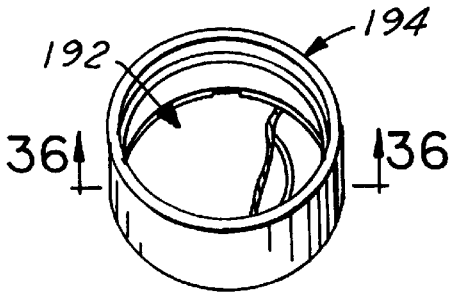
FIG. 35 is a fragmentary perspective view of one of the closure screw cap with a cut liner inserted therein by the machine and method of the invention.
Figure 36:
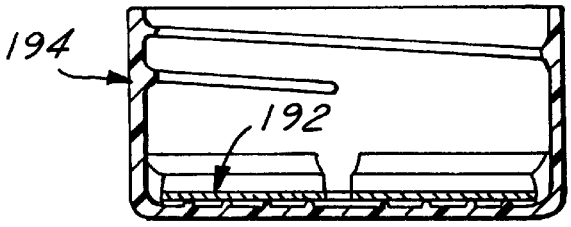
FIG. 36 is an enlarged sectional view taken on the line 36—36 of FIG. 35.

Rotary die 150 carries an array of cutting die inserts 190 (FIGS. 5 and 7; and shown separately in FIGS. 15–17) that cooperate with anvil 152 and the "pullback" web operational mode of nip rolls 170–176 to individually cut from web 160, in a closely nested pattern (FIG. 34), circular cut outs that are suitably sized and configured for insertion as liners 192 into associated closure caps 194 (FIGS. 35 and 36). Each die insert 190 cuts and then removes the associated liner 192 from web 160 then and carries the liner with it as it travels in a circular path in a half turn of die 150 into registry with an associated transfer post 200 mounted on a transfer roll 450 of transfer sub-assembly 114. The cut liner 192 is transferred by blow-off from the die insert 190 and by vacuum draw onto post 200, and then carried by the post during its travel with approximately 190° rotation of drum 450 until the transfer post registers with an associated closure cap 194 that is positioned for registry with the transfer post by escapement mechanism 124. As best seen in FIG. 32, liner 192 is inserted into cap 194 as the cap is drawn slidably out from the escapement by the post engagement and pushed along the presser shoe assembly 122 by the transfer post. When the cap/liner assembly 194/192 has been carried by the post over the discharge conveyor 120, it is ejected downwardly from the transfer post onto the discharge conveyor belt 800 for out-feed from machine 100 via chute 824.

Liner Web Cutting Method and Machine Operational Cutting Mode

Figure 18:
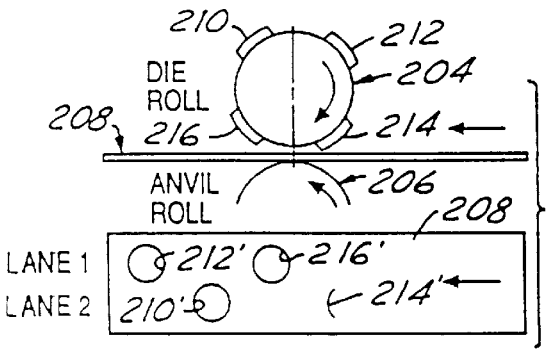
(PRIOR ART) FIG.18
FIGS. 18 and 19 are composite simplified diagrammatic views illustrating a mode of operation in successive stages of a typical prior art rotary die and associated anvil web cutting operation.
Figure 19:
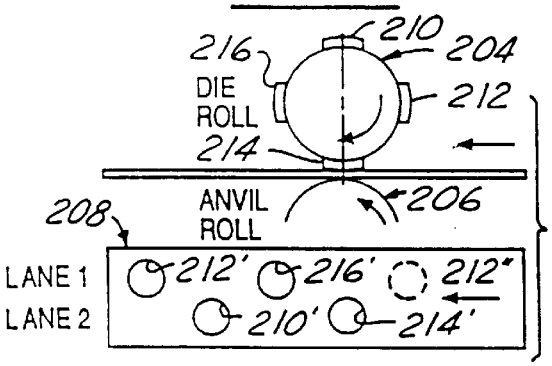
(PRIOR ART) FIG.19

It will be seen from the foregoing description of the general operation of machine 100 that a reasonably wide spacing of the inserter posts 200 from one another is required on transfer roll 114 so that each post can properly "pick" an associated cap 194 from feed chute 110. In the past one method and mode of accommodating such relatively large circumferential spacing of inserter posts on the transfer roll was to arrange the cutting dies on the die roll with like circumferential and lateral spacing to match that of the post spacing on transfer roll. Such a prior arrangement is illustrated in FIGS. 18 and 19 in simplified diagrammatic form, the upper portion of the view being a side view of a die roll 204 and opposed counter-rotating anvil roll 206 with a web of material 208 fed continuously at constant speed therebetween. Web 208 is shown in plan view in the lower portion of the figure as positioned between the rolls in the upper portion of the figure.

This prior art arrangement is premised on a "roll out pattern" of two "lanes" numbered "1" and "2" in FIGS. 18 and 19 laterally offset from one another axially of the die roll 204. The circumferential spacing of the four cutting elements 210, 212, 214 and 216 on die roll 204 is at equal angular increments and is so dictated by subsequent process steps so that no relative motion exists between a cut part and subsequent processing positions, that is, no "cut and slip" techniques are possible such as those described previously relative to certain prior art systems for handling large cut parts. In this prior art example, cutting dies 210 and 214 are aligned axially diametrically opposite one another on the surface of roll 204 in a circumferentially extending lane No. 2 array at one side of the roll, whereas cutting elements 212 and 216 are aligned diametrically opposite one another in a lane No. 2 array at the other side of the roll surface to provide a circumferentially staggered overall cutter array.

The post array on the transfer roll (not shown) is laid out to match that of the cutting dies on the die roll. Thus such a prior art machine has a transfer roll (not shown) for operable cooperation with die roll 204 with cut element pickup posts or the like with circumferential spacing matching those of the cutters 210–216 and driven with a transport speed to match up for individual "hand-off" registry with each of the cutting elements to thereby avoid slippage of the cut element in the direction of roll rotation, i.e., adjacent and along the tangential convergence zone of the travel paths of the cutter and post. The rotational velocity of the die and anvil rolls 204 and 206, and the feed motion of web 208 therebetween, are, of course, all uniform, unidirectional, constant, continuous and matched so that no relative motion occurs between the web and roll surfaces in their cutting zone of mutual engagement at any time during web feeding and roll rotation. As will be seen in the top view of web 208 in FIG. 18 die cutter 214 has just begun to cut web 208 at 214' in lane 1 of the web and cutters. Previously thereto, a cut opening or cut-out 216' in lane 2, cut-out 210' lane 1, and cut-out 212' in lane 2 have been formed in web 208 as the respectively associated cutting dies 216, 210 and 212 have sequentially engaged the web during passage thereof between the rolls in advance of cutter 214 reaching the position of FIG. 18.

With web 208 moving in the same direction at the same speed as the die and anvil rolls 204 and 206, and after the rolls have rotated 45° from the position of FIG. 18, they assume the position shown in FIG. 19. In the FIG. 19 position, die 214 has cut completely through web 208. The web has continued to move in the same direction and at the same speed as the die and anvil rolls. The cut-out opening 214' is now complete in web 208. This motion continues in a continuous manner and therefore the next cut is made in lane no. 2 when cutter 212 moves into cutting position on the web and cuts out another liner, leaving a cut-out opening 212" in the position indicated by broken lines. It thus will be seen that with the prior art arrangement of FIGS. 18 and 19 web material usage is not optimized and there is a lot of scrap between the cut-out openings 210'–216' in web 208 as so cut.

Figure 24:
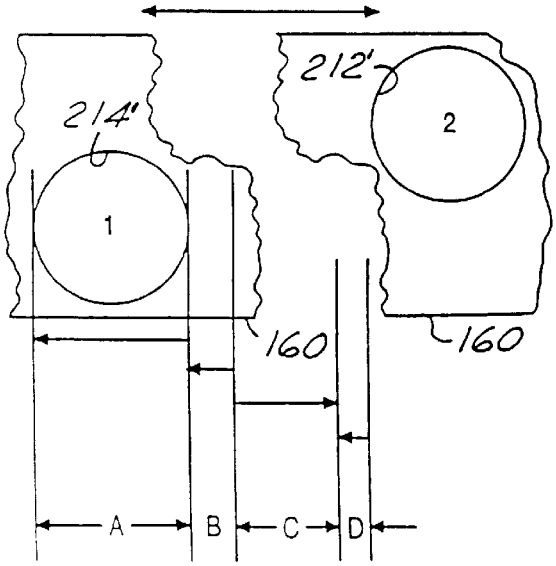
Figure 23:
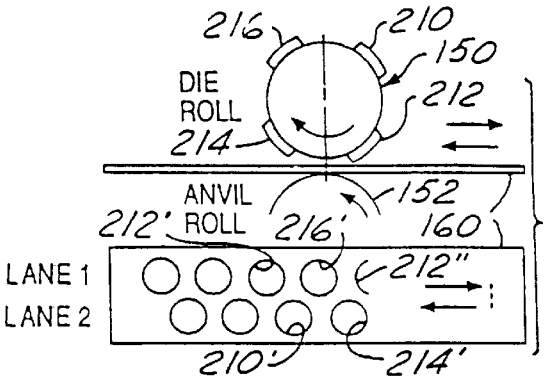

In contrast to such prior art, web material utilization is optimized in accordance with the present invention as set forth in simplified form in the schematic diagrams of FIGS. 20–23, as further explained in conjunction with the composite diagrammatic timing charts and graphs of FIGS. 24 and 24A. For ease of comparison assume die roll 150 is provided with the same array of two lanes of cutting dies 210, 212, 214 and 216 as the prior art die roll 204 FIGS. 18 and 19. However, as seen by the plan views of web 160 in FIGS. 20–23, in accordance with the present invention this same array of cutting dies 210–216 on roll 150 has produced a repetitive pattern of die cut-out-out openings 210', 212', 214' and 216' in lanes 1 and 2 during one revolution of die roll 150 which are much more closely spaced and internested in web 160 than the corresponding cut-outs in web 208. Yet the die roll 150 and anvil 152 are still operated with a continuous unidirectional rotary motion at uniform speeds in the manner of die roll 204 and anvil roll 206. The critical differences in achieving this unexpected and surprisingly improved result of closely spaced rotating die cut-out pattern resides in the novel manner in which web 160 is fed between the rolls as compared to the uniform speed unidirectional continuous feed motion of web 208 of the prior system of FIGS. 18 and 19.

In accordance with a "web pullback" feature of the invention, the rotary cutting die 150 can still be manufactured in the manner of the prior art knife die roll as to the widely spaced (but pre-determined gap) between cutting elements. Hence there is still present a circumferential "non-contact" area of the die roll wherein the spacing of successive cutting elements circumferentially of the roll surface is such that no cutting occurs as the die rotates and the web is not compressed between the successive cutting dies nor between the die roll and anvil roll, i.e., a "non-contact zone". The present invention takes advantage of this circumferential cutting element spacing and resultant clearance spacing between the die and anvil roll radially therebetween that together define the non-contact zone in order to thereby maximize utilization of the web material. This is achieved by reversing the web feed direction and thereby pulling the web back slightly during the period when no cutting is occurring, i.e., during occurrence of this non-contact zone. Then the web feed is again reversed and the web pulled forward again and at the same velocity as the cutting roll elements in timed relation with the engagement of the next successive cutting element with the web. The stopping of the forward motion of the web, the pullback motion, the resumption of the forward motion again and speed match to the rolls must be done during the time when the web is not being processed, that is, during the occurrence of the non-contact zone between cuts. It is to be noted that while the web is being repeatedly cut and pulled back in this manner, the die rolls and other downstream processing rolls in the machine are in continuous unidirectional motion at a constant velocity.

Figure 20:
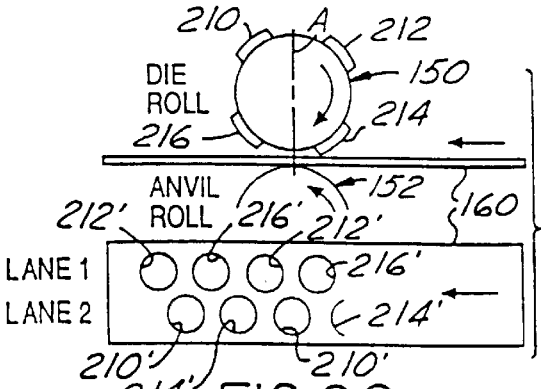
FIGS. 20, 21, 22 and 23 are composite simplified diagrammatic views illustrating successive stages in the operation of the rotary die cutter and associated anvil in operating on a liner web in accordance with the method and operation of the machine of the invention illustrated in FIGS. 1–17.

This web pullback system of the invention is diagrammatically illustrated in the sequence of FIGS. 20–23. In FIG. 20 web 160 is being pulled forward in the usual manner, i.e., in the direction of the web motion arrow at the same speed as the tangential velocity of cutting element 214 and the surface speed of rolls 150 and 152 where they converge in the web processing zone. Thus, in FIG. 20 the die 214 is shown as it begins to cut the web in lane 1 with the web moving in the same direction at the same speed as the die and anvil rolls. This initial cut is shown at 214' at the right-hand edge of lane 1 in web 160 in FIG. 20.

Figure 17:
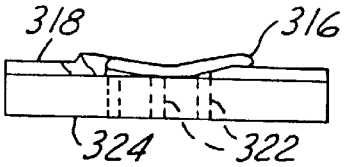
Figure 16:
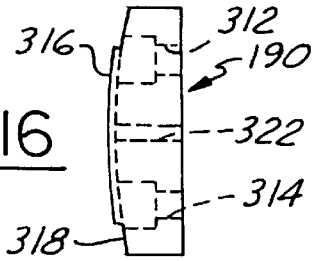
Figure 21:
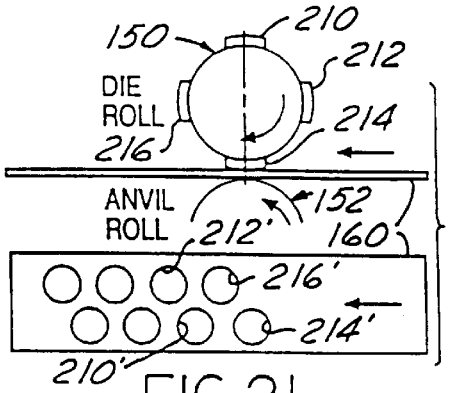
Figure 22:
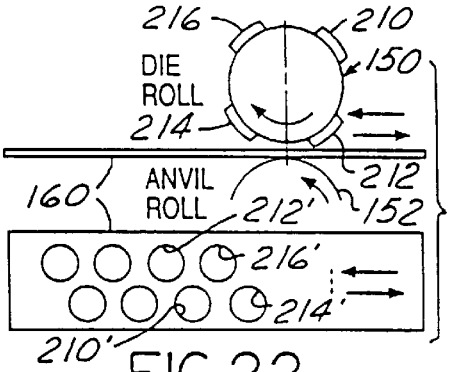

As rolls 150 and 152 continue to rotate at their uniform speed and web 160 continues its constant velocity forward feed motion it advances from its position in FIG. 20 to its position in FIG. 21. Cutting die 214 thus travels convergently with the web until centered with its axis on an imaginary line which runs through the axis of both the die and anvil rolls, such line being indicated by letter A and extended throughout FIGS. 20–23. The knife edge of cutting die 214 at this point has completely cut half of the full circle of cut-out opening 214' due to the arcuate curvature of the cutting die in the plane of the drawing (see knife edge 315 of cutting die inset 190 as shown in FIGS. 16 and 17). The cutting of the web liner material to form a complete circular disk cut-out within the confines of the circular cutting edge 316 of the die 214 is completed as the die and anvil rolls 150 and 152 continue rotating from their position in FIG. 21 to their position in FIG. 22. During this conjoint roll and web motion cutting die 214 is retracted out of the material of web 160, carrying with it the cut liner 192 severed from web 160.

However, immediately after the trailing edge of cutting die 214 emerges and clears from the upper surface of web 160, and in accordance with the "web pullback" feature, forward motion of web 160 is decelerated rapidly to zero and then its direction of feed is reversed to pull the web back relative to the surface of die roll 150. It will be seen that this occurs when the gap between cutting die 214 and the next successive die 212 is registering over the web as it is slidably, freely riding backward on the surface of anvil 152 i.e., during the occurrence of the aforementioned "non-contact zone". Then, just prior to cutting die 212 reaching the position of FIG. 23 the reverse motion of web 160 is decelerated to zero, and then the web is re-accelerated in the forward feed direction so that by the time cutting die 212 initially touches the upper surface of the web, the web is again moving forward at the same velocity as the cutting roll elements and anvil surface. Cutting die 212 then convergently engages, and its knife edge 316 enters, the web. Die 212 then continues to move through the same cutting motion path as the previous cutting die 214 in its excursion in the motion shown sequentially in FIGS. 20, 21 and 22. However it will be seen in FIG. 23 that the next cut is made in lane 2 of web 160 so that the corresponding web cut-out opening 212" is made closely adjacent to, laterally offset from and circumferentially overlapping the previous cut opening of 214 in lane 1. The resultant material savings from reduction in the percentage of scrap remaining in the processed web by so applying the "web pullback" web feeding system of the invention in the foregoing manner, without changing the rotary die and anvil roll setup and drive motion, can be readily seen by comparing the web 160 as diagrammatically processed in FIGS. 20–23 versus web 208 as comparatively diagrammatically processed in the prior art system of FIGS. 18 and 19.

The foregoing web pullback feed system mode of web feeding of the invention may be analyzed in more detail by reference to the composite diagrammatic timing charts and web velocity plots of FIGS. 24 and 24A. The circles 1 and 2 represent the rollout pattern of the cutting elements 214 and 212 on the surface of die roll 150, which would be the same rollout pattern formed by the posts 200 laid out for operation on the transfer roll 450 for such a rotary die 150. The cut-outs from web 160 formed by cutting elements 214 and 212 are labeled 1 and 2 and the corresponding web cut-out openings are labeled 212'and 214' respectively, but their spacing from one another in web 160 would be that shown in FIGS. 20–23.

In the web cutting operation as described hereinabove in conjunction with FIGS. 20–23, it will now be understood that the speed of web 160 matches the speed of die 214 when the liner pattern for cut-out 1 is being cut. After liner cut-out 1 has been cut, but before the pattern of liner cut-out 2 has been cut by die element 212 contacting the web, web 160 is drawn backward a predetermined amount which, for example, may be more than 50% of the diameter of hole 214'. Then, just prior to die element 212 contacting web 160, the web is advanced to match the surface speed of die element 212 and then the same cuts liner cut-out 2 from the web. Thus referring again to FIGS. 24 and 24A, in the above operation while die roll 150 is continuously rotating unidirectionally at a constant speed and moving its die elements 214 and 212 from cut-out 1 to cut-out 2, web 160 moves as follows:

(a) during travel increment A; web 160 moves forward (to the left as viewed in FIGS. 20–24) at exactly the same surface speed as die element 214 to cut pattern 1;

(b) during travel increment B; web 160 decelerates and comes to a complete stop;

(c) during travel increment C; web 160 feed reverses direction, and web 160 is pulled back a predetermined distance and stops (note that, as seen in the plots of FIG. 24A, web motion during this travel increment C includes both acceleration and deceleration of the web); and (d) during travel increment D; the feed direction of web 160 again reverses to move in the forward direction as the web is accelerated to match the surface speed of die element 212 in preparation of feed of the same to engage web 150 to make cut-out 2.

The foregoing process repeats for making die cut-out 2 and each successive cut-out in web 160. Again, the magnitude and direction of web feed velocity versus the corresponding travel increment distance for the travel distance increments A, B, C and D is schematically illustrated by the graph plot of these patterns in FIG. 24A.

The die element set up on knife roll 150 in the foregoing simplified example assumes a two-lane pattern of web cut-outs as shown in FIGS. 20–23. Assuming the circumferential spacing between successive cutting elements 210–216 of die roll 150 is twice the diameter of the cutting element, the roll circumference would be divided into 24 equal angular increments or "slots" of 15° each. Die elements 214 and 212 would thus occupy every third slot in an alternating sequence around the roll circumference in their respective lanes 1 and 2 that is made up of four die elements 214 and four die elements 212 (eight die cuts, sixteen spaces). If the desired output is 600 parts per minute, at eight parts per revolution of die roll 150, the constant operating speed of die roll 150 would be 75 revolutions per minute. Since in this example 15° of rotation of die roll 150 is required to produce a complete cut-out by the die element, the time for travel increment A would be 0.03 seconds. Since the next successive die cutting element 212 requires another 30° of rotation of die roll 150 before it contacts web 160, a time interval of is 0.066 seconds remains available in which to produce the web feed motions B, C, and D.

It will be understood that for the die cutter setup of machine 100 the cut-out pattern of web 160 is that shown in FIG. 34 in which multiple cuts are made simultaneously laterally or transversely across the web. Thus as shown there are five circumferentially extending lanes 1–5 laid out spaced axially across the surface of roll 150 in which cutting elements 190 are mounted. Cut-out patterns 1, 3 and 5 are cut simultaneously by three cutting elements 190 circumferentially aligned in lanes 1, 3 and 5, and also aligned in a three-element row parallel to the roll rotational axis. Cut-outs 2 and 4 are cut simultaneously by two cutting elements 190 circumferentially in the next successive two-element row aligned in lanes 2 and 4 and also aligned parallel to the roll rotational axis. The closely nested pattern of cut-outs 1–5 seen in web 160 in FIG. 34 is accomplished by utilizing the aforementioned web pullback method and mode of operation of the invention, these components and their mode of operation in machine 100 for accomplishing this web cut-out pattern being explained in more detail hereinafter.

Rotary Knife and Web Feed Sub-Assembly 112

Figure 2:
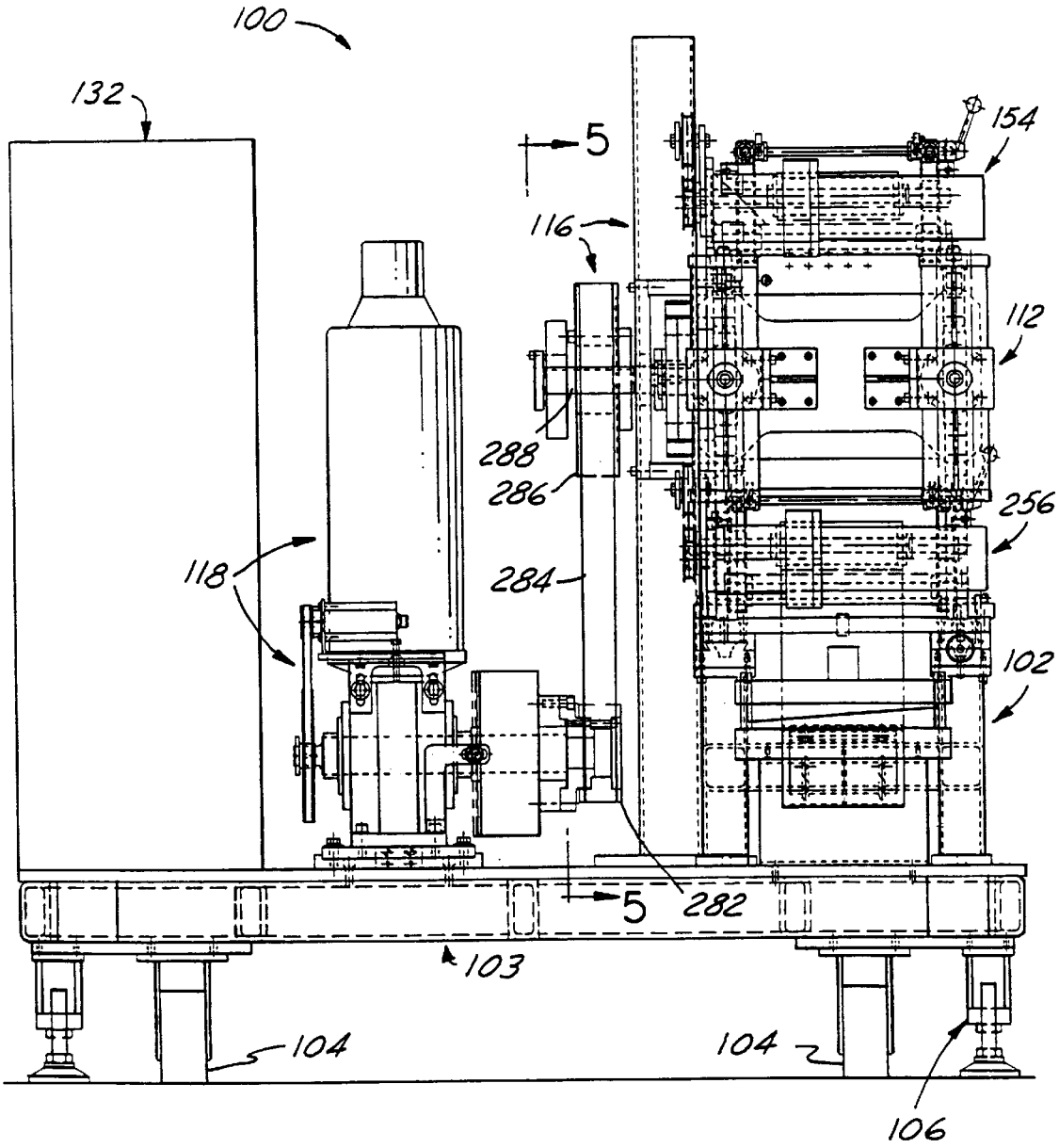
FIG. 2 is an end elevational view of the machine of FIG. 1 as viewed looking at the left hand end of the machine as seen in FIG. 1.
Figure 3:
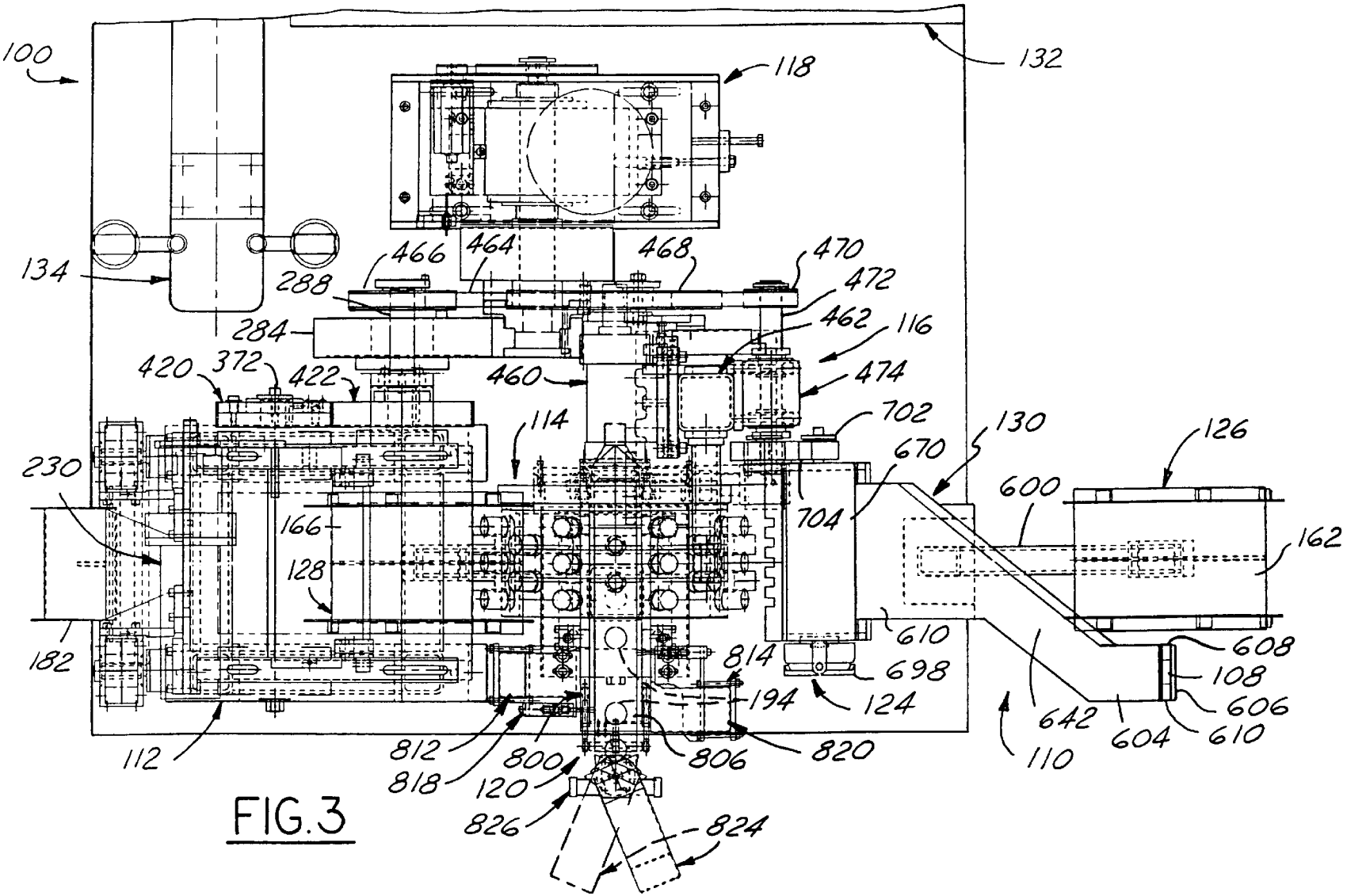
FIG. 3 is a top plan view of the machine of FIGS. 1 and 2 taken on the line 3—3 of FIG. 1.
Figure 5:
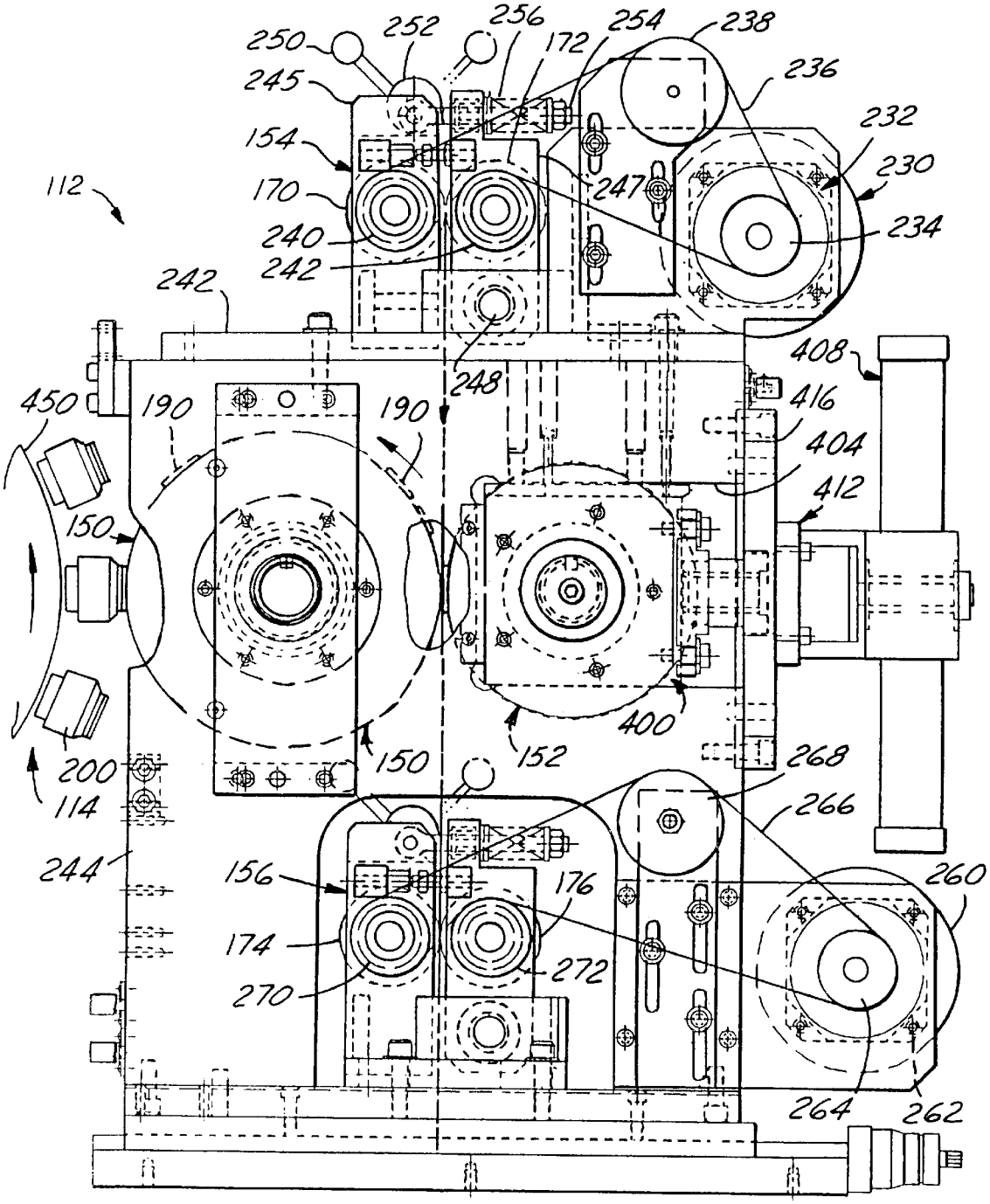
FIG. 5 is an enlarged vertical sectional view taken on the line 5—5 of FIG. 2 illustrating the rotary knife and web feed subassembly of the machine, with the associated transfer roll shown fragmentarily.
Figure 6:
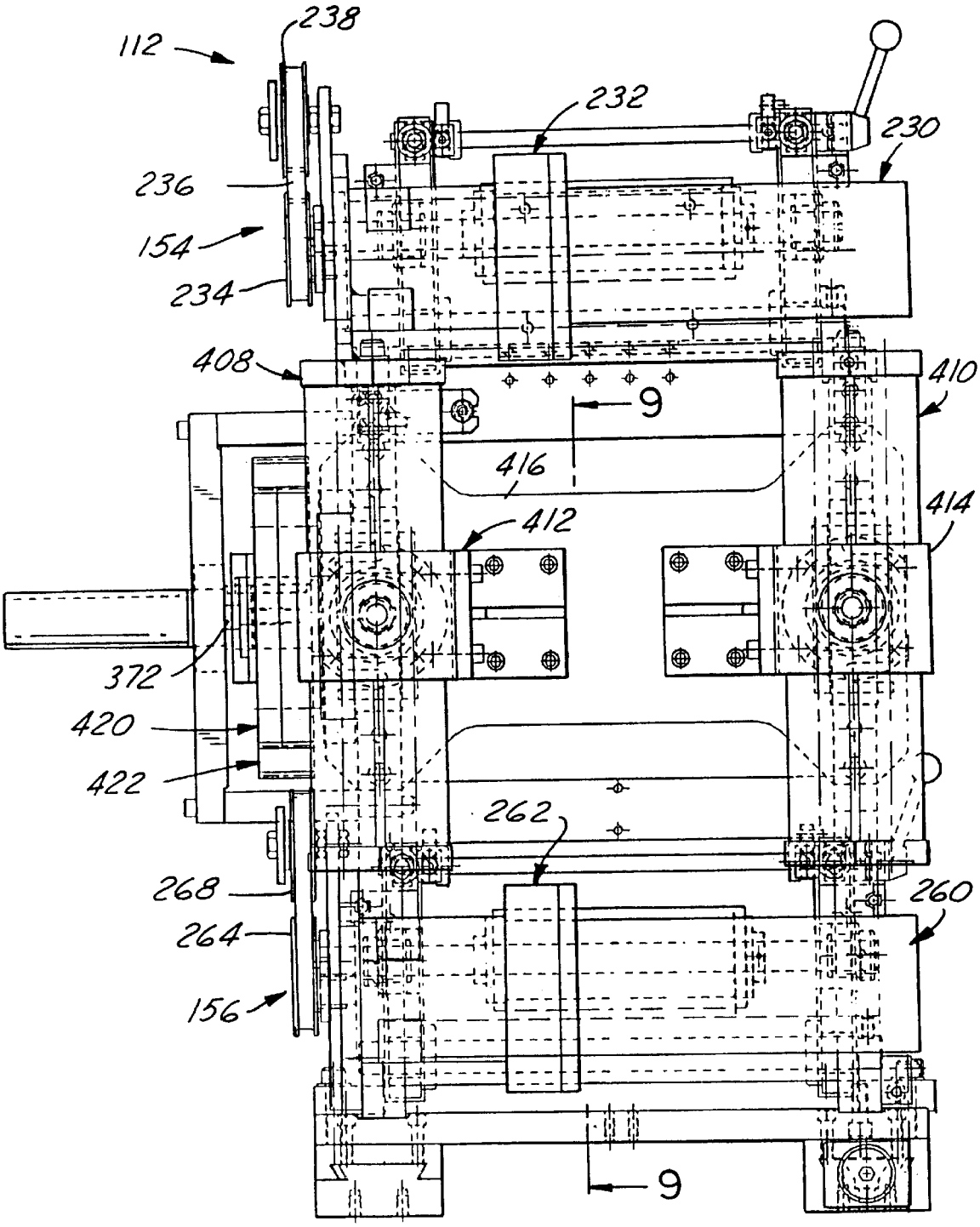
FIG. 6 is an enlarged end elevational view of the subassembly of FIG. 5 as viewed looking at the right-hand end of subassembly as shown in FIG. 5.
Figure 7:
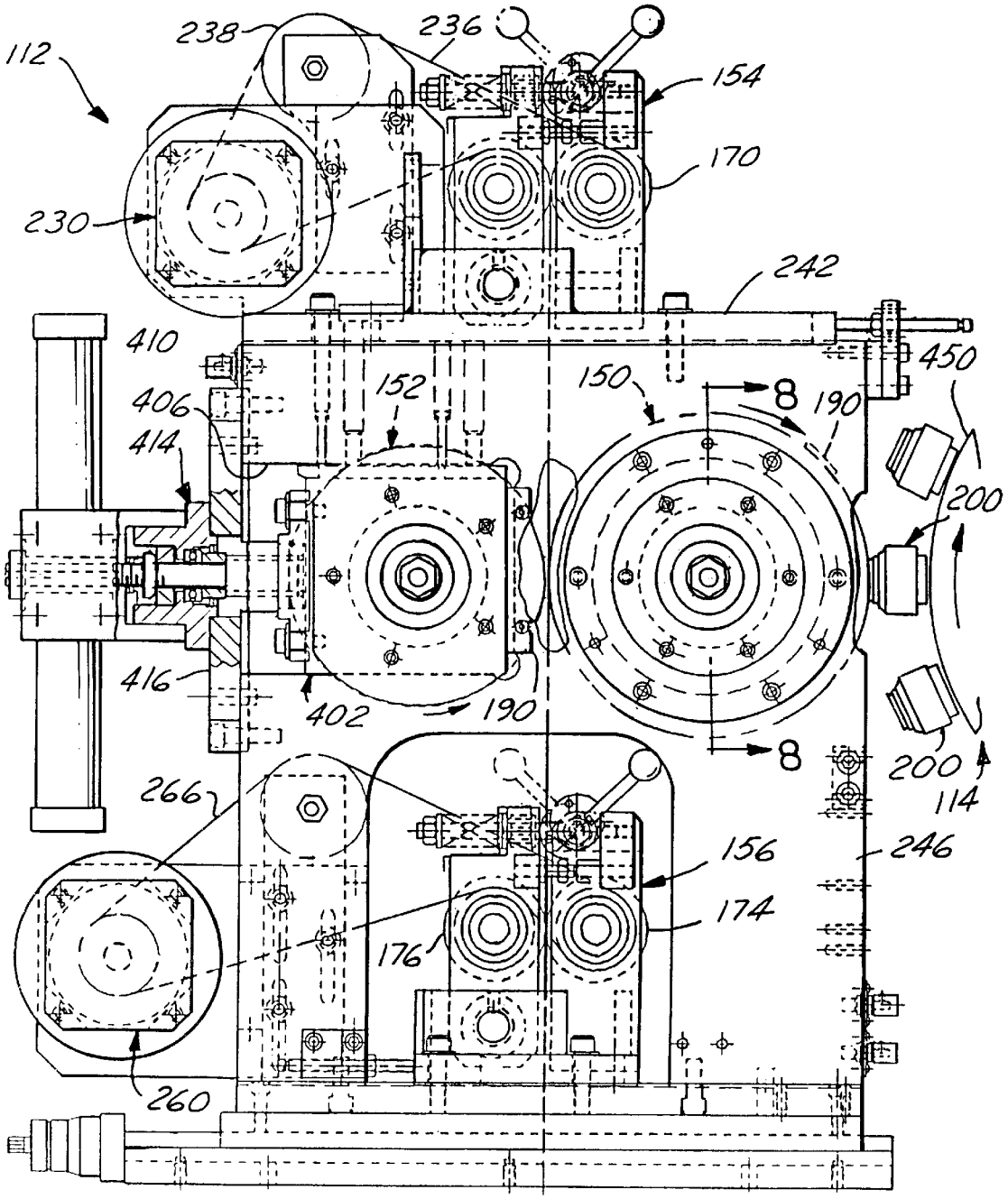
FIG. 7 is an enlarged side elevational view of the rotary knife and web feed subassembly shown in FIGS. 5 and 6, illustrating the side opposite that shown in FIG. 5.

The rotary knife and web feed sub-assembly 112 is shown by itself in FIGS. 5, 6 and 7, and components thereof in FIGS. 8–17, and in assembly with machine 100 in FIGS. 1, 2 and 3. As best seen in FIGS. 5–7, upper nip roll assembly 154 includes a commercially available servo motor 230 and associated gear box 232 having an output gearbelt pulley 234 drivingly coupled for counter-rotational drive of nip rolls 170 and 172 by a gearbelt 236. Gearbelt 236 is trained around drive gear-pulley 234, up over an idler pulley 238 and then around drive gear-pulley 240 of nip roll 170, and then up and over the drive gear-pulley 242 of nip roll 172 and thence back to pulley 234. Motor 230, gear box 232 and idler pulley 230 are mounted by suitable brackets as shown in FIGS. 5–7 on a bracket plate 242 and in turn mounted across the main side frames 244 and 246 of knife and feed assembly 112. Nip roll 170 is journaled in fixed brackets 245, and nip roll 172 is journaled in brackets 247 pivoted at their lower ends at 248 and swung thereon into nip engagement with roller 170 by operation of a hand lever 250 coupled through an eccentric cam 252, eye-bolt 254 and compression coil spring 256 to bracket 247.

The lower nip roll assembly 156 is constructed and arranged in a manner similar to upper nip roll assembly 164 and is provided with its own drive comprising servo motor 260, gear box 262, output gear-pulley 264, drive gear-belt 266, idler 268 and drive gear-pulley 270 and 272 for nip roll 174 and 176 respectively. Servo motors 230 and 260 are automatically set-up, adjusted and controlled by a conventional CPC system with an associated control and display panel (not shown).

Rotary Knife Subassembly 150

Figure 8:
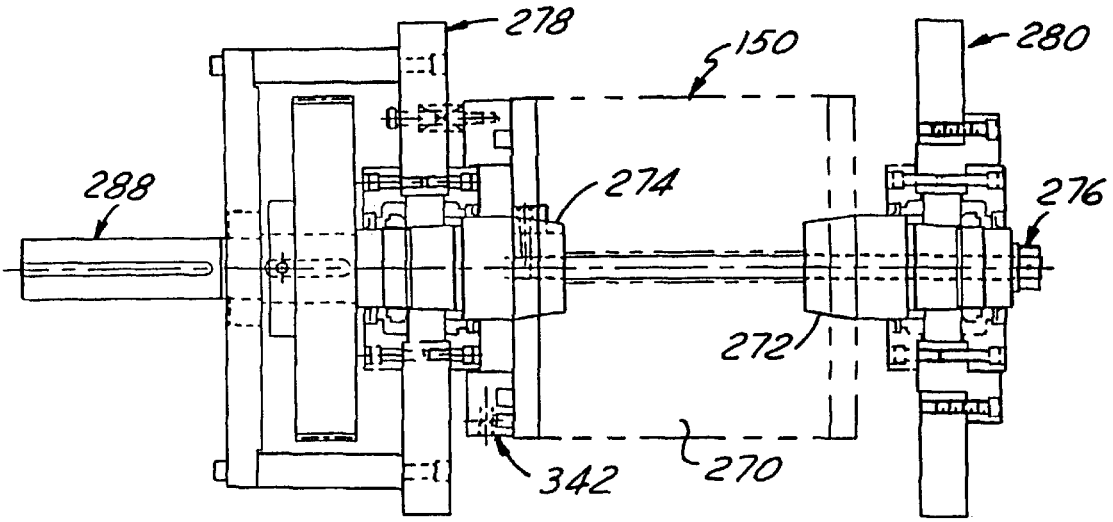
FIGS. 8 and 9 are vertical cross-sectional views respectively taken on the line 8—8 of FIG. 7 and line 9—9 of FIG. 6.
Figure 9:
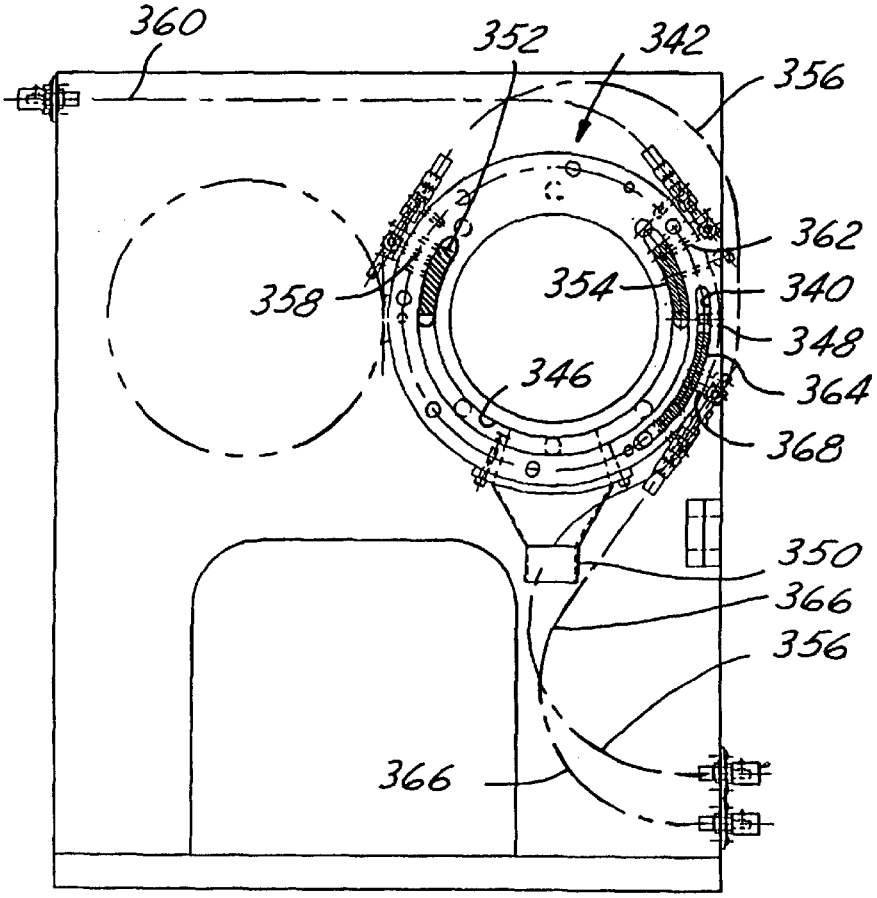
Figure 10:
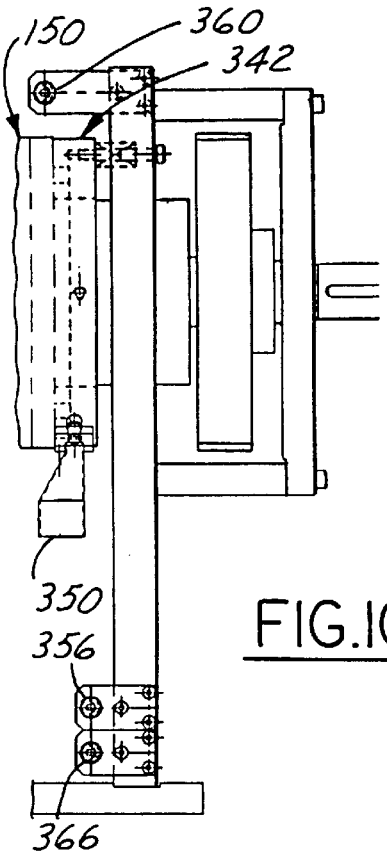
FIG. 10 is a fragmentary rear elevational view of the left-hand side of the mechanism as viewed in FIG. 5 and projected off the rear face as viewed in FIG. 9.

Rotary knife subassembly 150 is best seen in overall assembly in FIG. 1, in subassembly in FIGS. 5 and 7 and in the detail FIGS. 8, 11, 12 and 15–17. Rotary knife subassembly 150 comprises a solid cylinder of light metal alloy machined to have an octagonal peripheral surface 270 (see FIGS. 11 and 12) and mounted on conical end spindles 272 and 274 interconnected by a tie rod 276. The spindles are preferably journalled at their ends for rotation in journal-less spindle mounting structures 278 and 280 such as those disclosed in U.S. Pat. No. 5,417,132, assigned to Atlantic Eagle Inc., of Farmington Hills, Mich., assignee of record herein, which is incorporated herein by reference and not further described in detail. Die roll 150 is rotatably driven by the drive motor of main machine drive assembly 118 and which has its output drivingly coupled to knife roll 150 via a drive gear-pulley 282, drive gear-belt 284 and driven gear pulley 286 keyed on spindle shaft 288 (FIGS. 2 and 8).

Figure 11:
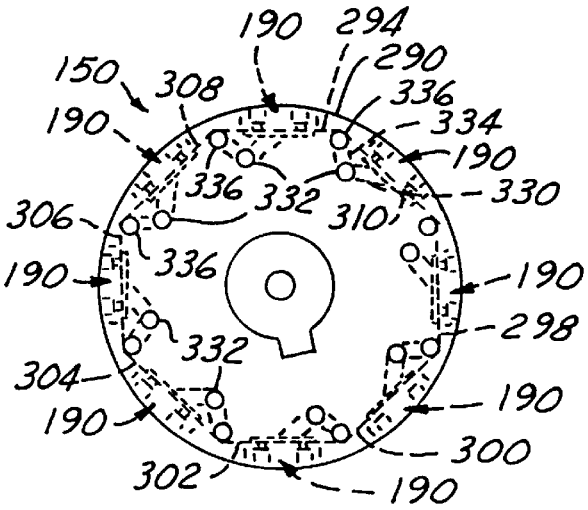
FIGS. 11 and 12 are end and side elevational views respectively of the rotary die drum shown by itself.
Figure 12:
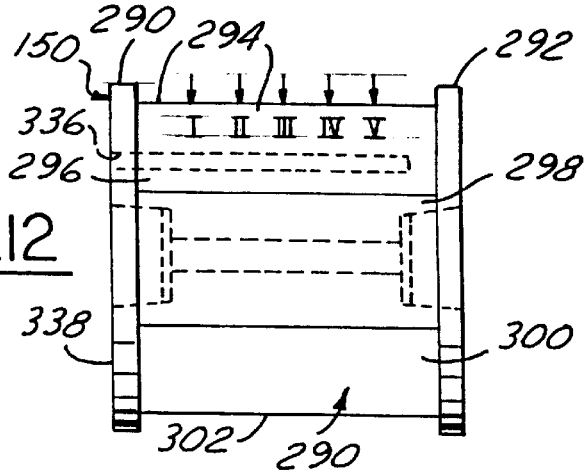

As best seen in FIGS. 11 and 12, die roll 150 is formed with a pair of cylindrical integral end rings 290 and 292 and an intervening peripheral surface 270 that has an octagonal cross-sectional configuration (FIG. 11) recessed radially inwardly from the O.D. of rings 290, 292. Eight flat mounting platform surfaces 294, 296, 298, 300, 302, 304, 306 and 308 are thus provided at equal angular increments that extend axially between end rings 290, 292 for mounting thereon an array of twenty cutting die elements 190. These die elements are arranged in five circumferentially extending lane rows, centered on the lane positions designated with the roman numerals I–V in FIG. 12 at equally spaced increments axially of roll 150. Roll lanes I–V correspond to the web cut-out pattern arranged in longitudinally extending cut-out pattern rows likewise designated I–V in FIG. 34. Three of these inserts 190 are mounted on top flat 294 centered at lane positions I, III and V. Two of these inserts 190 are mounted on the next adjacent flat 296 and centered on lane positions II and IV. This closely spaced mounting pattern of inserts 190 is repeated in a circumferentially alternating three-cross row and two-cross row pattern around the remaining flats of die roll 150.

A shallow circular cavity or recess 310 (see FIG. 11) is provided at each of these insert mounting locations on the flats 294–308, along with a pair of threaded mounting holes (not shown) flanking each recess 310. Each die insert 190 has a pair of shouldered through holes 312 and 314 (FIGS. 15–17) for alignment with the roll mounting holes for insertion therethrough of threaded mounting bolts. The circular cutting die knife 316 of each cutting element is V-shaped in radial cross-section (FIG. 17) and has a convex curvature matching that of the recessed outer face 318 of the insert and disposed flush with the periphery of end rings 299 and 292 in mounted position of the insert on the roll. The convex face 320 of insert within the confines of knife edge 316 is formed on the same radius of curvature of surface 318 and is penetrated by a series of air passages 322 (FIGS. 15–17) that extend to the bottom face 324 of insert 190. Each mounting recess 310 on roll 150 is approximately the same diameter as knife 316 and receives an O-ring seal at its periphery for air-tight clamping between insert bottom face 324 and the bottom of the recess when the insert is mounted thereover. A pneumatic fluid communication chamber is thus formed beneath each insert communicating holes 322, via a drilled passage air 330, with a vacuum supply passage 332, and via an interconnecting passage 334 with a superatmospheric air supply passage 336. Each of these eight vacuum supply passageways 332 and eight pressurized air supply passageways 336 in roll 150 open at ports in the end face 338 of end ring 290 (FIG. 11). These end ports of passageways 336 and 332 are spaced at 45° angular increments around the end face in concentric circular rows that respectively align with a pressurized air supply channel 340 and a vacuum supply channel 346 (FIG. 9) formed as side-opening arcuate grooves in a manifold plate 342 (FIGS. 9 and 10) stationarily mounted against the end face 290 of die 150. A source of compressed air is connected to the radially outer manifold pressure air, groove channel 340 via a port 348, and the vacuum source 134 of machine 100 is coupled to a nozzle 350 attached to the underside of the manifold 342 and communicating with the radially inner vacuum groove channel 346.

The "on" and "off" timing of vacuum communication from channel 346 to each row of cutting elements 190 is controlled respectively by a "vacuum-on" packing 352 and a "vacuum-off" packing 354. These packings are inserted in sealed relation in the vacuum channel 346 adjacent its circumferentially opposite ends and are circumferentially moveable therein through an adjustment range for controlling such on and off vacuum timing to each insert cross-row. Adjustment movement of packings 352 and 354 is respectively controlled by Bowden wire cables 356 and 360 having their respective free ends coupled associated arms 358 and 362 moveable in associated slots of manifold plate 342 and respectively attached to packings 352 and 354. In a similar manner pressurized air on-timing is controlled by a "pressure-on" packing 364 moveably mounted in sealed relation in pressure supply groove 340. A Bowden wire cable 366 is connected at its free end via an arm 368 moveable in a slot in manifold plate 342 to thereby control the onset of application of compressed air to each row of die inserts as its associated pressure port 336 travels past the upper end of packing 364 (counterdockwise as viewed in FIG. 9) to thereby connect the port to pressure channel 340 for about 10° of further knife die rotation (followed by shut-off as the port travels past the end of the channel).

Anvil Subassembly 152

Figure 13:
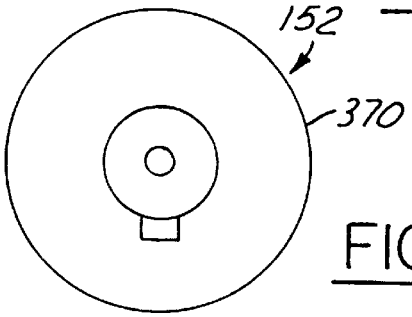
FIGS. 13 and 14 are end and side elevational views respectively of the rotary anvil drum blank shown by itself.
Figure 14:
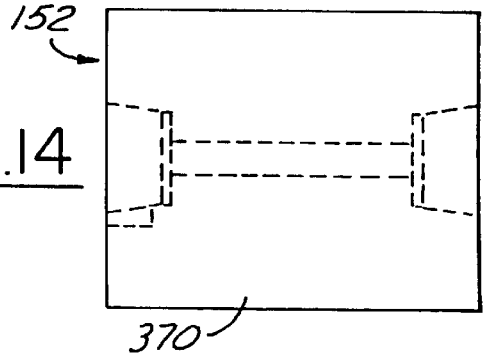

Anvil subassembly 152 is shown in assembly with machine 100 in FIG. 1, as a subassembly in FIGS. 5, 6 and 7 and the anvil roll 152 by itself in FIGS. 13 and 14. Anvil roll 152 preferably comprises a solid cylinder of hardened alloy steel finish ground to have a true cylindrical peripheral surface 370. Anvil roll 152, like die roll 150, is rotatably supported by a journal-less spindle mount structure at each end in accordance with the aforementioned U.S. Pat. No. 5,417,132 patent and hence not described nor shown in detail. These journal end supports are carried in a pair of journal slide blocks 400 and 402 (FIGS. 5 and 7) on gibs in side slots 404 and 406 of side frame plates 244 and 246 respectively.

Mechanized adjustment of the proximity of anvil roll 152 to die roll 150 is controlled by conventional air cylinder rack and pinion units 408 and 410 mounted on brackets 412 and 414 in turn mounted to a cross-brace plate 416 spanning across and fastened to the rear edges of frame plates 244 and 246.

Preferably, air cylinder units 408 and 410 are computer controlled and respond to a web splice seam signal detected by a suitable sensor so as to back off anvil 152 (within the tooth mesh range of the drive gears) to thereby increase the predetermined spacing of its surface 370 from that of die roll 150 during passage therebetween of the webs splice seam. Alternatively, a standard manually adjusted pressure screw system can be utilized if the machine is stopped in "home" position and the web splice is then driven through the roll gap by manually controlling the web feeding servo motors.

Synchronized driving rotation of anvil roll 152 counter to that of die roll 150 is provided by an anti-backlash dual gear set 420 keyed non-rotatably on the end of the spindle shaft 372 of the anvil roll (FIGS. 3 and 6) and which is driven by mesh with a gear 422 keyed on the spindle shaft 288 of die roll 150. The gear ratio of gears 420 and 422 is matched to the diameters of rolls 150 and 152 so that the surface speed of these rolls is the same.

Transfer Mounting Post Roll and Drive Subassembly 114

Figure 4:
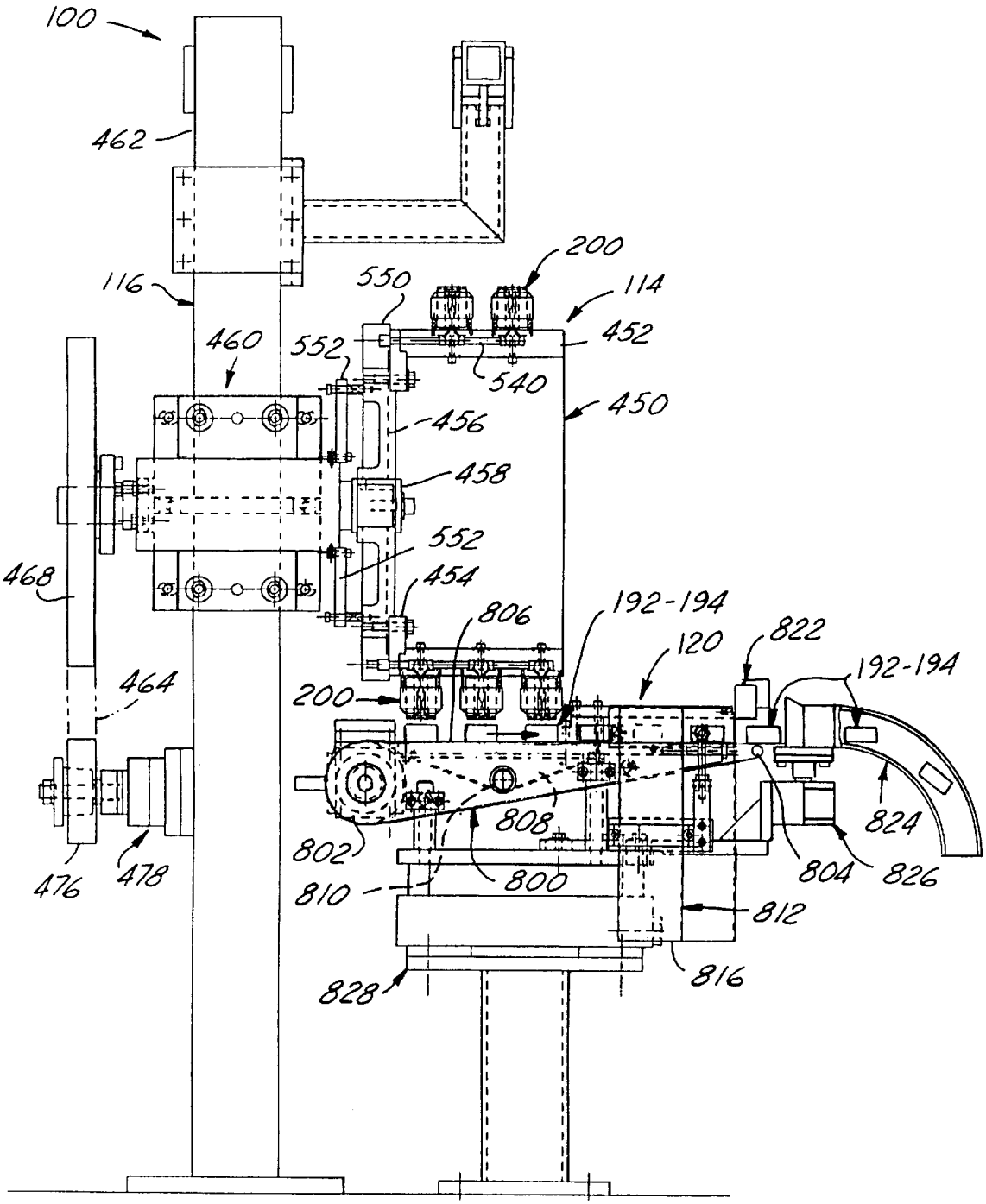
FIG. 4 is a vertical sectional view taken on the line 4—4 of FIG. 1.
Figure 25:
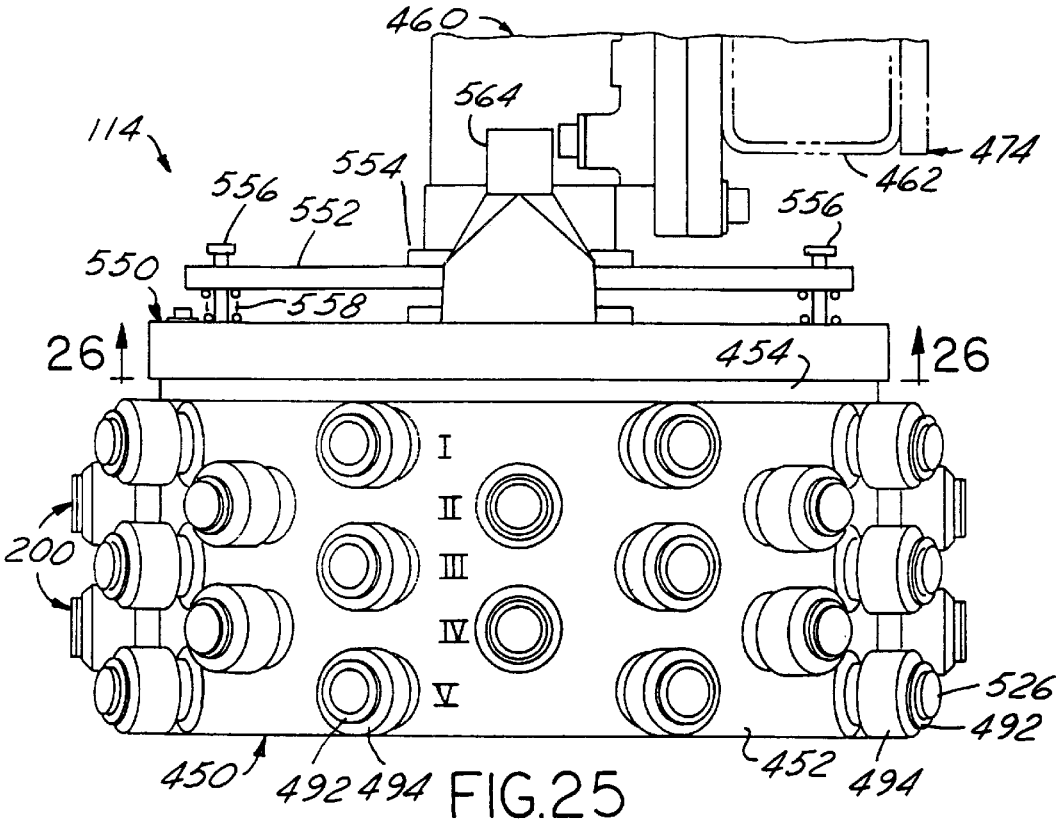
FIG. 25 is an enlarged fragmentary plan view of the rotary transfer drum taken on the line 25—25 of FIG. 1.
Figure 26:
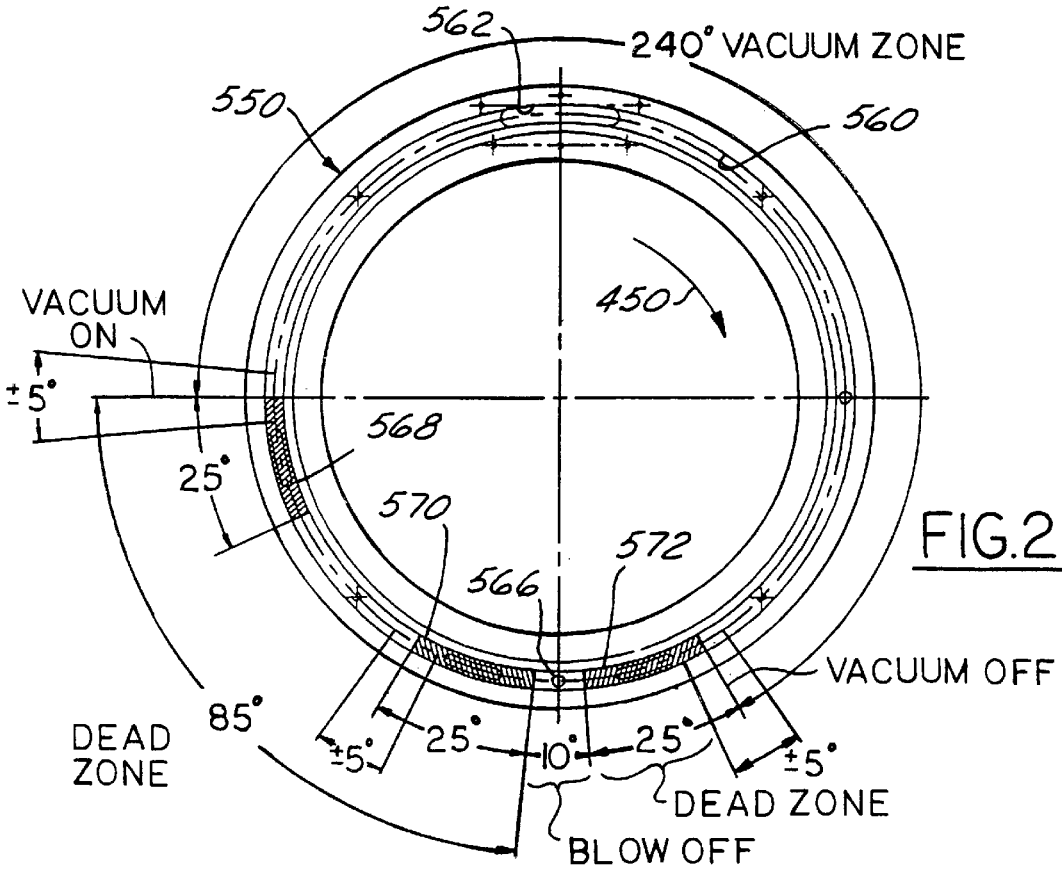
FIGS. 26, 27 and 28 are sectional views taken respectively on the line 26—26 of FIG. 25, and line 27—27 of FIG. 1, and line 28—28 of FIG. 27.
Figure 27:
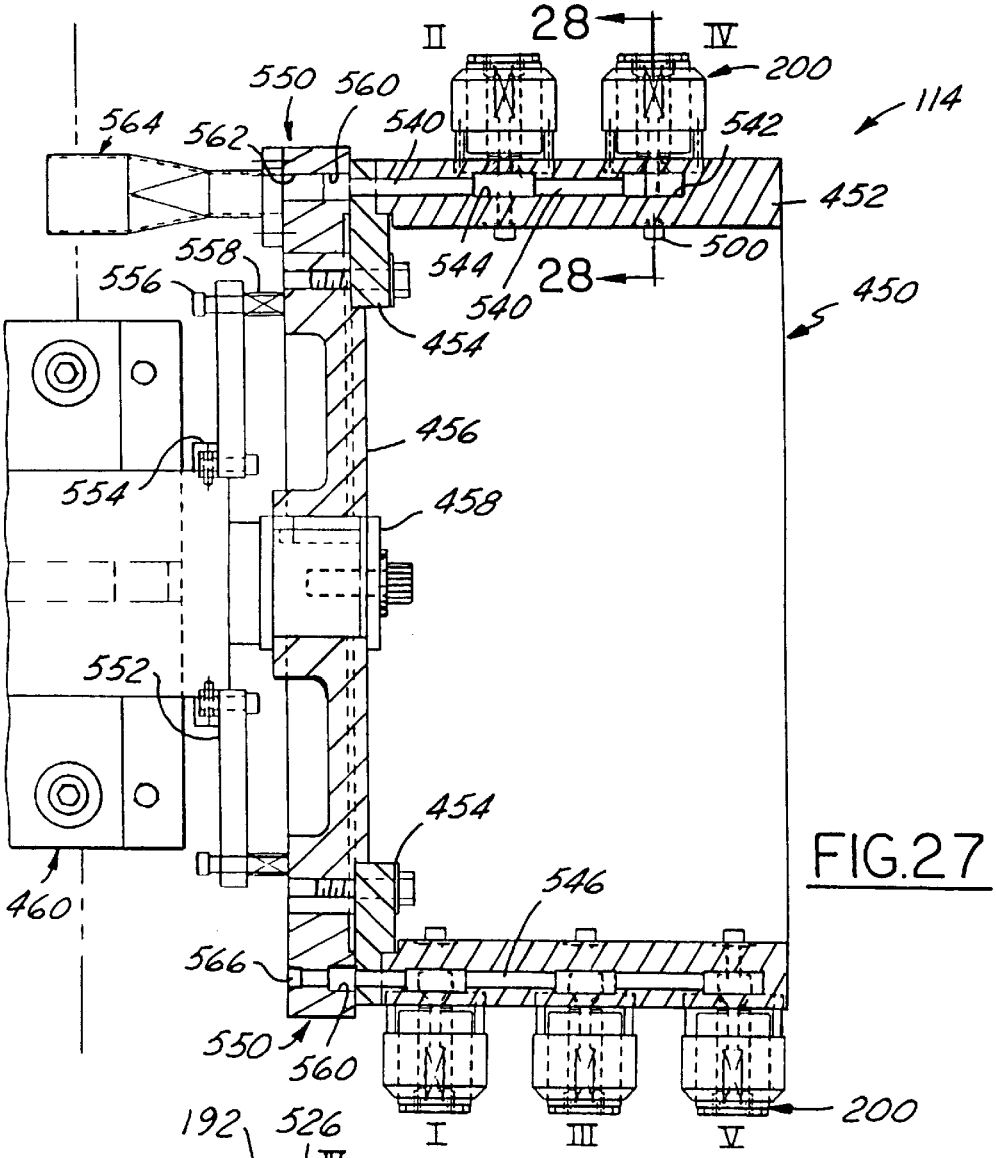
Figure 28:
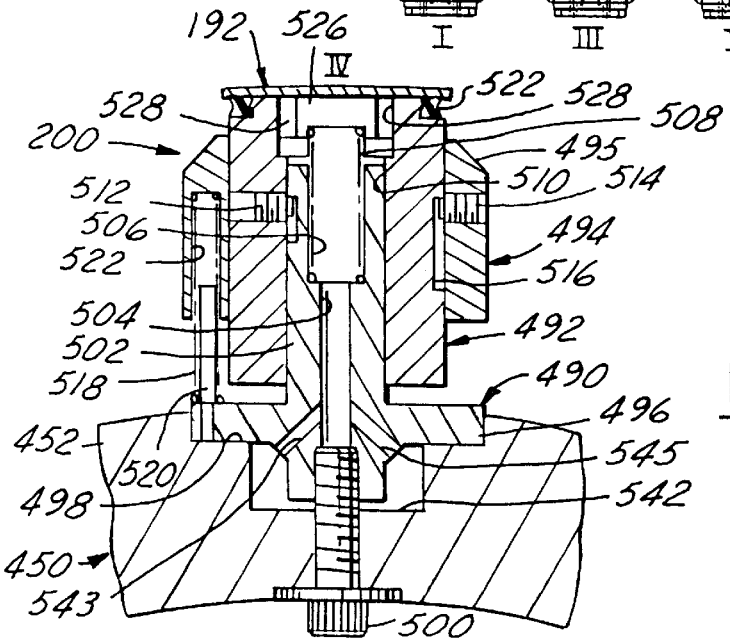

The transfer roll subassembly 114 with transfer roll 450 carrying mounting posts 200 is shown in assembly with machine 100 in FIGS. 1, 3 and 4, as a separate subassembly in FIGS. 25 and 27, and details thereof in FIGS. 26 and 28. Referring to FIGS. 25 and 27, the subassembly comprises a transfer roll 450 made up of a cylindrical drum band 452, a drum ring 454 welded to the inboard or rear end edge of band 452 and a drum disk back 456 to which ring 454 is bolted. Drum 450 is mounted by back 456 on a drive shaft 458 rotatably journaled in a bearing pillow block assembly 460 mounted on a vertical post 462 of the mounting post and drive assembly 116.

The drive for transfer subassembly 114 is provided by a gearbelt 464 trained around a drive gear-pulley 466 (FIGS. 1 and 3) keyed on the end of shaft 288. Gearbelt 464 has its upper run trained under a gear pulley 468 (FIGS. 3 and 4), mounted on the end of transfer roll shaft 458 opposite drum 450, and then is trained around a gear pulley 470 mounted on an escapement drive shaft 472 rotatably supported in a bearing block assembly 474 mounted on post 462 opposite pillow assembly 460. The lower run of gearbelt 464 is trained under an idler pulley 476 mounted on a shaft and bearing assembly 478 also supported on post 462 (FIGS. 1 and 4). Transfer drum 450 and its associated drive train from the drive for knife die roll 150 is provided with appropriate gear pulley ratios to produce a synchronized surface speed at the outer ends of posts 200 exactly matching that of die elements 190 on knife die roll 150.

As best seen in FIGS. 25, 27 and 28, drum 450 is about twice the diameter of die roll 150 and carries on its outer periphery an array of cut liner transfer and mounting posts 200, double in number from that of the cutting die elements 190 on knife roll 150, i.e., forty posts 200 versus twenty die elements 190. Posts 200 are arrayed in a pattern on the periphery of drum ring 452 as best seen in FIG. 25, wherein the circumferentially extending lanes I–V correspond exactly to and are aligned roll-to-roll with the like numbered-lanes on die roll 150 seen in FIG. 12. Likewise, posts 200 are arranged in circumferentially alternating cross-rows of three posts and two posts in the manner of the die cutting element layout on knife roll 150. The spacing between these rows circumferentially of transfer roll 450 is also laid out so that the outer ends of post 200 in one row are spaced(center-to-center distance circumferentially) from the outer ends of the posts in the next circumferentially adjacent post row the same distance as the corresponding center-to-center spacing of die elements 90 in adjacent rows on knife die roll 150. Hence with roll 450 rotating at exactly half the angular velocity of roll 150 each row of posts 200 will meet the corresponding row of die elements 190 as the same are come into coaxial registry in a plane drawn through the rotational axes of knife roll 150 and transfer roll 450, as indicated in the view of FIG. 1. At this point the cut liners 192 being carried on the associated cutting die elements 190 of the registered die row are transferred, by cutter blow-off and cooperate post suction, to the registered row of posts 200 solely by a "non-ship" transfer motion of liner 192 axially in the direction of the axis and coaxial with the axes of registered die elements and posts when coincident. After transfer onto posts 200 the liners are carried thereon, in the circular path of travel of posts 200 with transfer roll rotation, to the closure cap pickoff station at the outlet of escapement mechanism 124, as described in more detail hereinafter.

Construction of Transfer Post 200

As best seen in FIG. 28, each transfer post 200 is of identical construction and comprises an inner post 490, an outer post 492 telescoped on inner post 490, and a sleeve 494 encircling outer post 492. Inner post 490 has a circular mounting flange 496 seated in a circular recess socket 498 provided in the outer periphery of drum ring 452. A cap screw 500 removably secures post 490 in the drum ring socket in the manner shown in FIG. 28. Inner post 490 has a cylindrical stem 502 projecting radially outwardly from the drum ring with a central through-bore 504 threaded at its lower end to receive cap screw 500 and open to a counter bore 506 at its upper end which in turn receives a coil compression spring 508. Outer post 492 has a through-bore 510 slidably receiving stem 502, and post 492 is keyed for travel axially along stem 502 by a half-dog set screw 512 having its dog point end captured in an axially extending key way 514 in stem 502. Outer post 492 can thus travel on stem 502 between a radially outer-most position shown in FIG. 28 to a radially innermost position in which the lower end of outer post 492 bottoms on inner post flange 496. Sleeve 494 is likewise telescoped on the outer surface of outer post 492 for travel axially relative thereto between stop limits set by the dog end of a half-dog set screw 514 riding in a key way slot 516 in the outer surface of outer post 492. The outermost travel limit of sleeve 494 relative to both outer post 492 and inner post 490 is shown in FIG. 28.

Sleeve 494 is biased radially outwardly relative to the drum by a coil compression spring 518 sleeved over a spring retainer pin 520 mounted in flange 496. The upper end of pin 520 as well as that of spring 518 is received in a spring socket 522 of sleeve 494. An identical spring pin, sleeve biasing spring and sleeve spring socket are provided on the diametrically opposite side of post 200 in like manner, but not shown. A quad-ring seal 522 is carried in a shoulder groove at the upper end of outer post 492 so as to protrude slightly beyond flush with the annular end face 524 of outer post 492. An end closure portion 526 of outer post 492 captures the upper end of spring 508 to bias post 492 radially outwardly slidably relative to inner post 490. Outer post 492 and portion 526 has four equally spaced air passages 528 extending axially therethrough and communicating with counterbore 506.

Machine 100 provides vacuum pickoff of each cut liner 192 from the associated cutting die element 190 onto the protruding end of the associated post 200 at the transfer registration point between rolls 150 and 450, as well as compressed air blow-off of the cut liner 192 from the transfer post during insertion and seating of the same into the associated closure cap 194. For this purpose air passageways are provided in drum ring 452 as shown in FIGS. 27 and 28, and for each transfer post cross-row. Thus for the two posts shown in lanes II and IV in FIG. 27 there is a passageway channel 540 extending parallel to the drum axis and terminating in an annular end chamber 542 coaxially formed as a counter bore extension of socket 498 in lane IV (FIG. 28). Channel 540 communicates through another intermediate chamber 544 likewise formed in association with post 200 in lane II. Channel 540 extends through ring 454 and opens at the end face thereof. Another of these channels 546 is seen in the lower portion of the view of FIG. 27 in association with the three-post row of posts 200 located in lane positions I, III and V.

Rotary valve timing action for sequentially turning on and off subatmospheric and superatmospheric pressure source communication with posts 200 via channels 540, 546, etc. in drum ring 452 is provided by a manifold ring 550 that encircles drum back 456 and is held against rotation while being spring biased against the rotating face of drum ring 554. Manifold ring 550 has a "floating" support on a square mounting plate 552 which in turn is stationarily affixed to a mounting ring 554 fastened on pillow block 460. Four of cap screws 556 are threaded at their ends into the manifold ring 550 and their smooth shanks protrude through associated holes in the corners of mounting plate 552. A compression coil spring 558 in sleeved on each screw 556 between ring 550 and plate 552 to provide spring bias pressure to force mounting ring 550 sealably against drum ring 454.

The manifold porting of ring 550 is shown in FIG. 26. It will be seen that the face of ring 550 adjacent drum ring 454 is provided with a circumferentially continuous 360° annular groove 560 which communicates at its upper end with a vacuum port passageway 562. A vacuum nozzle 564 mounted to the backside of manifold ring 550 registers with passage 562 and is suitably connected by a vacuum line (not shown) with continuous vacuum source 134. A pressure supply passage 566 (FIGS. 26 and 27) extends axially through manifold ring 550 diametrically opposite vacuum port 562 and opens interiorly into annular groove 560. A pressure line (not shown) is connected to port 566 by a suitable fitting (not shown) and communicates with a continuous source of compressed air (not shown).

As shown in FIG. 26, manifold groove 560 is provided with three packing seals 568, 570 and 572 oriented circumferentially in their locations respectively shown in FIG. 26 to provide, beginning with the upper end of packing 568, a vacuum zone extending 240° clockwise to packing 572, then a 25° dead zone coextensive with packing 572, then a 10° blow off zone in the space between the adjacent ends of packings 572 and 570 and in registry with port 566, and then an 85° dead zone extending from the end of packing 570 closest to port 566 clockwise to the upper end of packing 568. As indicated in FIG. 26, the packings are adjustable in annular groove 560 and set up to established end limits of these vacuum, blow-off and dead zone ranges as may be needed in the set up of machine 100.

Thus it will be seen that all posts 200 in those post cross-rows having their associated fluid communication passages 540 registering with manifold groove 560 in the vacuum zone between packings 568 and 572 will have sub-atmospheric pressure communicated to the post end surface ports 528 via the associated passage 540, post chamber 542, slot passages 543 and 545 in inner post 490 stem center passage 504, and through spring 508 to the chamber at the underside post of end portion 526. The direction of rotation of drum 450 relative to manifold ring 550 is indicated by the arrow 450 in FIG. 26. Hence the onset of application of vacuum ("vacuum-on") to each mounting post 200 occurs when its travel reaches the point labeled "vacuum on" in FIG. 26, which corresponds where a cross-row of posts 200 meets a corresponding cross-row of die elements 190 at the coaxial coincidence line extending through the rotational axes of drums 150 and 450 (see also FIG. 1). The "vacuum-off" point in the travel path of each mounting post 200 is so labeled and is established by the right-hand end of seal 572 as viewed in FIG. 26. The orientation of drum ring 550 as shown in FIG. 26 corresponds to its orientation in an assembly as mounted in machine 100 as shown in FIG. 1.

As the drum passages 540 encounter seal 572, vacuum is shut off to these passages. When they register with the space between seals 572 and 566, superatmospheric pressure is communicated to those passages 540 registering with the "blow off" portion of groove 560 between seals 572 and 570, Hence pressurized air is then supplied through the aforementioned supply passageway path to the post end ports 528 of each post 200 in the post cross-row as it registers with the blow-off zone. This produces a blow-off action on the cap liner 192 as it is inserted and seated by its post 200 into an associated closure cap 194. When each passageway channel 540 registers with the end of seal 570 closest to port 566, compressed air is shut-off and remains so until this passage travels back-up to the "vacuum-on" point just past seal 568.

Diverter Track Sub-Assembly 110

The feed chute and diverter track sub-assembly 110 is shown in assembly with machine 100 in FIGS. 1–3 and as a sub-assembly with the associated escapent mechanism 124 in FIG. 29. As shown in FIGS. 1 and 3, feed chute 110 is in form of inclined gravity slide track angled in plan view (FIG. 3) to cross over and be supported by the inclined arm 600 of a support post 602 of the upstream web guide sub-assembly 126 (FIGS. 1 and 3). The chute comprises a top plate 604 shaped in plan view as shown in FIGS. 3 and 29, a like-shaped bottom plate 606 spaced apart parallel to the top plate by a pair of laterally spaced guide side rails 608 and 610, these plates and rails thereby defining a feed chute passageway 616 of rectangular cross-section slightly larger than that of a closure cap 194. Part guide rails 608 and 610 are fastened to bottom plate 606 by a series of caps screws 612, and top plate 604 is mounted on guide rails 608 and 610 by butthead screws 614.

The single file closure slide passageway 616 runs from inlet 108 adjacent the upstream web guide apron 162 downwardly through a 30° angle turn, and then through a straight run down to diverter section 130 best seen in FIG. 29. Chute 110 widens out at diverter 130 to form three parallel closure feed lanes 618, 620, 622 leading downwardly and angled at 30° to single file passageway 616. The center lane 620 is formed by two part guide rails 624 and 626. The right hand lane 618 is formed by rail 624 and an outer side rail 626 which is an extension of rail 610. The left hand lane 622 is formed by rail 626 and an outer guide rail 628 forming an extension of rail 608. Due to the inclination of passageway 616 at 30° to vertical as viewed in FIG. 29 and the overall inclination of diverter track assembly 110 at about 45° to horizontal in the plane of the drawing (FIG. 1), closure caps sliding by gravity down the single file feed lane 616 are biased gravitationally and hence tend to enter the upstream entrance of lane 618 until full, then into the middle lane 620 and lastly left hand lane 622.

The gravity slide feed of closures down chute 110 and further through diverter section 130 is air-assisted by coupling the outlet of a compressed air line to the inlet nipple of a side-mounted manifold 630. Three output tubes indicated at 632, 634 and 636 are inserted at their outlet end respectively into drilled passages 633, 635 and 637 in top wall 604 inclined downwardly in the downstream direction. These air jet passages are located at the entrance to each of the lanes 618, 620, 622 to air-jet-push closures along into these three lanes. In addition, a further upstream air assist stream is fed through an outlet of a tee elbow 638 to an outlet feed outlet tube 640 which is connected to a similar air jet passage 642 in the top wall as indicated in FIG. 3. The input feed rate of single file closure cap 194 into chute inlet 108 is established to keep all three diverter lanes substantially full with closures as they feed downwardly into escape mechanism 124.

Escapement Sub-Assembly 124

Due to the circumferentially alternating pattern of two post and three post cross-rows in the array of posts 200 on transfer roll 450, as designed to accommodate the like array of cutting elements 190 on knife roll 150, which in turn achieves the closely nested pattern of liner cut-outs shown in FIG. 34, it is not possible to feed closures 194 side by side in three fixed lanes to both the two post and three post cross-rows. Escapement mechanism 124 of the invention overcomes this dilemma by alternately shifting the outlet or leading cap 194 in each of the three rows of caps, as fed by the lanes 618, 620, 622, so that they are shifted on a three-cap group between two alternate pick-up positions along a shift line parallel to the rotational axis of the transfer roll. In a first position, three lead caps 194 are positioned for individual registry with the three posts 200 of a three-post row, thereby allowing such posts to individually withdraw the three caps 194 simultaneously from the escapement for insertion of cut liners 192 individually therein, and then feed the cap/liner assembly 194/192 to discharge conveyor 120. In the second position of the escapement, the three lead caps 194 are shifted into alignment with the travel path of the transfer posts 200 of a two-post row which follows in sequence after the three-post row. These two posts then register with two of these three shifted lead caps in two of the three cap feed lanes. The cap in the third lane is missed by these posts in the two-post row and hence is retained by the escapement for supply to the outer post of the next three-post row upon escapement shifting back to the first outlet position.

More particularly, as best shown in FIGS. 29–33, escapement sub-assembly 124 comprises a base plate 650 attached by strap connectors 652 (FIG. 1) to abut and align flush with the bottom wall 606 of chute I IO. Base plate 650 in turn is supported by a pair of side plates 654 and 656 (FIGS. 32 and 33) mounted parallel to one another on the opposite edges of a bottom plate 658 of the escapement sub-assembly frame work. Plate 658 in turn is mounted on the upper end of a support post 660, constructed and arranged on the machine frame work as shown in FIG. 1. Escapement 124 also has a transparent cover plate 670 mounted parallel to and spaced above bottom plate 650 by spacers 672 and associated cap screws and forming an extension of the cover plate 604 of diverter 130.

The interior of escapement 124 is sub-divided into three closure feeding passageways by four guide track bars 674, 676, 678 and 680 each pivotally mounted on base plate 650 by an associated shoulder screw and bushing 682 at their upstream ends so as to form swingable wall extensions of the upstream diverter walls of the three guide channels 618, 620, 622. The guide track bars 674–680 are linked for swinging movement in parallelism by being individually pinned to a cross slide bar 684 supported to slide against the undersurface of base plate 650 by a pair of guide bars 686 and 688 ( FIGS. 32,33). Guide track bars 674–680 are shown in solid lines in FIG. 29 their left end limit position, and in phantom by broken lines when swung to their right end limit position. As illustrated with reference to guide track bar 676 (in its right hand position), a shoulder screw 690 is inserted from beneath slide 684 through a hole therein, through an elongated slot 692 in base plate 650 and then threaded upwardly into a threaded hole in track bar 676 to thereby serve as an actuating pivot link between the track bar and slide. Like pivot connections are made between the cross slide 684 and the remaining track guide bars. The guide track bars are pivoted in unison by reciprocation of slide bar 684 as actuated by a pin 694 riding in the circumferentially extending groove 696 of a rotary cam 698. Cam 698 is keyed for rotation with a drive shaft 700 journalled in the side plates 654 and 656 of the escapement frame and driven at its opposite end by a gear pulley 702 (FIG. 3).

The drive for escapement cam 698 is taken off shaft 472 (FIG. 3) by means of a gear pulley 704 mounted for rotation on shaft 472 at the end thereof opposite gear pulley 470 (FIGS. 1 and 3) by means of a driving gearbelt 706 trained around pulley 704 and extending down partially around pulley 702, thence over an idler pulley 704, then down around pulley 706 for conveyor belt 800 of discharge conveyor 120, and thence back up to pulley 704. The escapement drive is thereby synchronized with the drive for transfer roll 450 and knife roll 150.

Each of the three left hand guide track bars 674, 676 and 678 carries on its trailing or downstream end a spring escapement mechanism for yieldably releasably holding back an adjacent closure 194, as well as those closures 194 that may be stacked up therebehind upstream in escapement 124 and diverter 130. The escapement stop for track guide bar 674 is shown in the portion of FIG. 29 encompassed by the circle A and shown by itself fragmentarily enlarged in plan view in FIG. 30 and in elevation in FIG. 31. Each closure escapement comprises a stop finger 710 pivotally mounted at one end by a pin 712 within a rectangular notch 714 opening to the end and passageway side of its track bar. A spring plunger 716 is mounted in a cross passage 718 to bear against the side of stop finger 710 to yieldably bias it to outward to a closure holding position shown in solid lines in FIG. 30, as limited by a stop pin 720 extending into recess 714. Finger 710 is pivoted to the dotted line position shown in FIG. 30 when the lead closure 194 is pulled past the finger by engagement with an associated transfer post 200 traveling into registry with this lead closure when held by the escapement. Identical escapement mechanisms with associated stop fingers 722 and 724 are mounted one on each of the down stream ends of track guide bars 676 and 678.

In FIG. 29 a row of closures 194 are shown in phantom filling each of the pivotal guide ways of escapement 124 when the guide tracks have been swung fully to their right hand limit. In this position the leading closure 194 fed from passageway 622 held back by the stop finger 710 and is oriented open end up centered on the travel lane I of transfer roll 450 (in a plane taken perpendicular to the rotational axis of transfer roll 450 and coincident with travel path I), likewise the leading closure 194 fed from middle passageway 620 is being held back by stop finger 727 and oriented open end up centered on travel lane III. The third closure 194 fed from passageway 618 is held back by stop finger 724.

As best seen in FIG. 32, the escapement is shifted to this right hand position just as a three-post row of posts 200 are approaching the outlet of the escapement. Then outer ends of these three posts engage the three lead closures 194 being held back by fingers 710, 722 and 724, and proceed to pull these closures, against the bias of their stop springs, so to slide t hem forward out of the escapement on to an apron 730 of the presser shoe sub-assembly 122. This allows the next successive closure cap to in each of the three rows 618, 620 and 622 to advance into lead position against stop fingers 710, 722 and 724 respectively.

Assume cam 698 has driven cross slide 684 all the way to its left end limit to thereby swing the four track guide bars 674–680 to their leftmost position shown in solid lines in FIG. 29. As indicated by the three lead closures shown in solid lines in each of the three swingable passageway outlets shown in this position, two of these three lead closures, i.e., those being held back by the escapement stop fingers 722 and 724, are now centered on lanes II and IV in the next successive two-element row. Hence these two closures are now ready for registry, engagement and removal from the escapement by the two transfer posts 200 in that two post row which immediately follows the aforementioned three-post row. Upon such engagement by the two posts of the two-post row, the two caps held in lanes II and IV are simultaneously pulled past their associated escapement fingers and slide out of escapement onto apron 730.

It will be seen that the third closure cap 194 held by escapement finger 710 between bars 674, 676 (i.e., that cap appearing in circle A) has been shifted to a nonpick-up position relative to the two posts 200 of the two post row. Hence this left hand most cap is not removed from the escapement outlet but rather is missed as this two-post row passes by the escapement. Upon removal of the two caps in lanes II and IV, these vacant positions are filled by the lead caps sliding down from the line of caps stacked up in passageways 618 and 620, thereby supplying a closure cap against each stop finger 722 and 724. Thus there are now three closure caps once again positioned at the outlet end of the escapement.

Cam 698 then reciprocates slide 684 to its extreme right hand position to swing bars 674–680 to their extreme right hand position as shown in phantom in FIG. 29. This shift of the three supply passageways thereby positions a leading cap in each row into a post pick-up position centered on lanes I, III and V, ready for registry with and removal of all three caps by the three posts of the next succeeding three-post row on transfer roll 450. The next three caps in the line up in each of the three escapement passageways then advance one position to thereby supply three more caps to be held back by the escapement stop fingers 710, 722 and 724 respectively. It will thus be seen that caps are withdrawn from closure supply passageway 618 and 620 at twice the rate that they are withdrawn from the left hand passageway 622.

Figure 33:
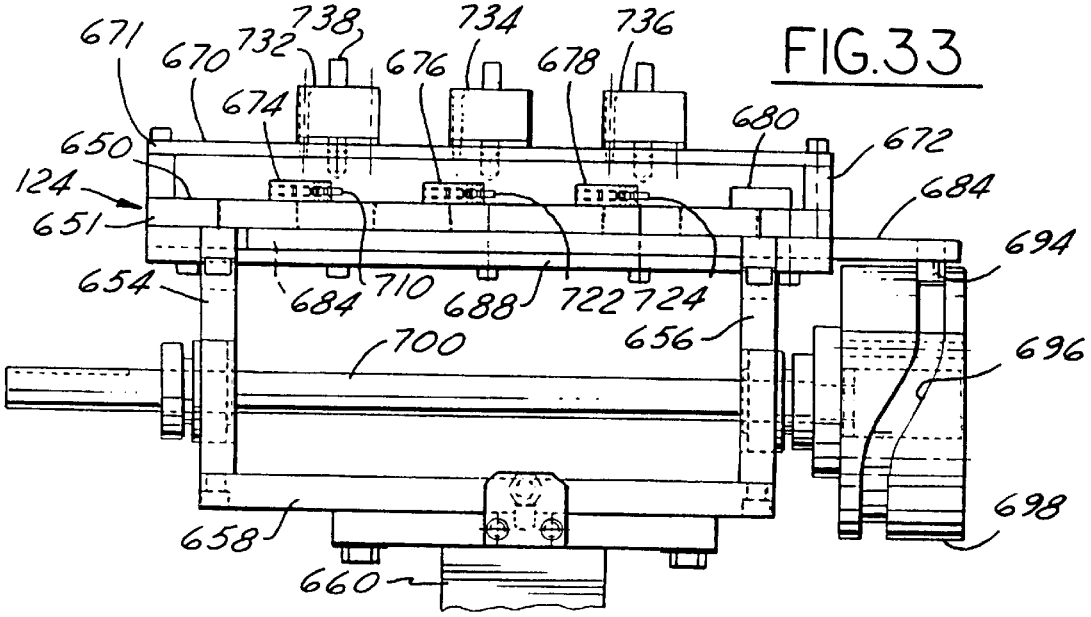
FIG. 33 is an end elevational view of the escapement subassembly taken on the line 33—33 of FIG. 32.

Escapement 124 is also provided with a cap feed malfunction detection system in the form of three double acting air cylinders 732, 734 and 736 mounted on cover plate 670 in the positions as shown in FIGS. 29, 32, 33. Each of these air cylinders has a plunger 738 which can reciprocate between a fully raised position, wherein its lower end is withdrawn flush with the under surface of cover plate 670 through which it protrudes, and a fully lowered position striking bottom plate surface 650 (closure cap missing). When the unit is actuated to force plunger 738 downwardly into the open end of a cap 194 located therebelow, the lower tip will strike the underside of the inverted cap top to thereby limit its down travel to this corresponding predetermined partially lowered position. A proximity sensor 740 (FIG. 32)

associated with each air cylinder provides a "Go" signal when the upper end of the plunger is limited in its down stroke by such closure engagement. However, if a cap is missing in the space below plunger 738, the plunger bottoms out on the upper surface on escapement base plate 650, thereby dropping the upper end of the plunger 738 far enough down relative to the proximity sensor 740 so that the same produces a "No-Go" output signal to the sensing system. Likewise, if a closure cap is fed not properly converted (as shown), a "No-Go" signal will also result. As seen in FIG. 29, the air cylinders are located sufficiently upstream in the alternate paths of travel feed of caps in the swinging escapement so as to enter the cap of its positioning by the swinging track bars 674–680.

As best seen in FIGS. 29 and 32, the downstream edge of cover plate 670 is beveled at 671 and spaced upstream from the downstream end 651 of base plate 650 by approximately three quarters of a cap diameter. As best seen in FIG. 32, this enables each transfer post 250 to just clear at its outer end cover plate edge 671, as shown by its arcuate travel path arrow line TP in FIG. 32. It will be seen that this path enters the open top of an inverted cap 194 being held for post pick-off by an associated escapement finger. The downstream portion of the inverted cap skirt projects into travel path TP so that it is engaged by the leading surface portion of beveled outer edge 495 of post sleeve 494 when the post reaches its travel position shown in FIG. 32. As post 200 travels past the position shown in FIG. 32 in convergence toward tangential apron surface 731 (in the direction of rotation R transfer of roll 450) post 200 will further enter into the upper end of the cap and drag it with the post, with sufficient force to overcome the spring bias holding the associated escapement stop finger 710, 722, 724, so that the cap is forcibly slid along upper surface 731 of apron 730.

Presser Shoe Sub-Assembly 122

The presser shoe sub-assembly 122 is shown in assembly with machine 100 in FIG. 1, as a sub-assembly in association with escapement sub-assembly 124 in FIG. 32, as well as partially in FIG. 29. Presser shoe sub-assembly 122 comprises an arcuate plate 734 having a concave upper surface 736 that merges flush at its upstream end with surface 731 of apron 730. Apron 730 is pivotally connected by shoulder screws 738 and 740 to the upstream end of chute 734. The upstream edge of apron 730 has five fingers 742 (FIG. 29) that swingable interdigitate with corresponding five notches 744 provided across the downstream edge 651 of escapement bottom plate 650. Shoe 734 is supported by and welded onto the upper end of an adjustable slide plate 746 of a mounting bracket 748 in turn mounted on the frame work of machine 100. An adjustable spring plunger unit 750 is pivotally mounted at its lower end to a clevis bracket 752, carried on plate 746 and is pivotally connected at its upper end to another clevis bracket 754 fastened to the underside of apron 730.

In normal operation, spring unit 750 is adjusted under no load to maintain apron surface 731 slightly below flush with the upper surface of escapement bottom plate 650, as shown in FIG. 32 to facilitate sliding pick-off of caps 194 when being dragged out of the escapement by transfer post travel engagement. Normally, as a post 200 is entering farther into an associated inverted cap 194 during conjoint travel along apron 730, the spring bias support of the apron and its pivotal connection to fixed shoe 734 allows it to yield slightly downwardly at its upstream edge by pivoting about the pivot pins 738, 740 in response the reaction forces then occurring between the cap and post sleeve 495 as the cap forces the sleeve yieldably back towards the transfer roll against the bias of its associated mounting springs 522. However, if a jam condition should occur between post 200 and a cap 194 during initial movement together over apron surface 731, apron 730 will yield further against the bias of spring unit 750. Such excessive pivotal yielding of apron 730 is then sensed by a proximity sensor (not shown) to provide both a warning signal and a control signal to stop the drive of transfer roll 450, die roll 150 and escapement 124.

Discharge Conveyor Sub-Assembly 120

Discharge conveyor sub-assembly 120 is shown in assembly with machine 100 in FIGS. 1 and 3, and as a sub-assembly in association with transfer roll 450 in FIG. 4. Discharge conveyor sub-assembly 120 comprises an endless conveyor belt 800 trained at one end around drive pulley 802 (FIG. 4) and at the other end around a small idler pulley 804 so that its upper run 806 travels parallel to the axis of transfer roll 450 and is disposed horizontally below the "6o'clock" position of roll 450. Belt 800 is driven continuously for travel of run 806 out of the front of the machine in the direction of the arrow in FIG. 4. The downstream edge 737 of presser shoe 734 (FIG. 32) is positioned to terminate above and flush with the right hand edge of the conveyor belt as viewed in FIGS. 1 and 3. Each cross-row of transfer posts 200 individually carry associated closure caps 194, each with a cut liner 192 inserted and assembled therein, over the upper surface of run 806 at a spacing thereabove slightly greater than the axial dimension of closure 194 (FIG. 4). The blow-off zone of transfer roll 450 is centered over the middle of upper run 806 so that the liner/closure assemblies 192–194 are ejected downwardly off of their associated transfer post at this transfer roll cap/liner discharge station by the combined ejection forces of pressurized air and bias of post springs 508 and 522, and thereby rapidly drop onto the surface belt run 806.

Belt 800 has three rows of closely spaced perforations located centrally thereof and running lengthwise of the belt oriented to underlie the closure drop-on positions (not shown). These rows of belt perforations travel over a vacuum plenum 808 connected to vacuum source 134 by a nozzle 810 and oriented with its open top in registry with the belt perforations so that closures ejected from transfers post are sucked downwardly onto conveyor belt run 806. This belt vacuum is maintained through belt upper run 806 until it reaches the downstream end of plenum 808 just short of where the upper run enters the upstream reject closure discharge chute 812.

Photoelectric sensors (not shown) are positioned above the travel path of the closures on belt run 806 and are operable to inspect each closure/liner assembly to determine the existence of any defective assembly, i.e., cutliner not fully bottomed in the closure. If such a defect is detected a blow off nozzle unit 814 is actuated to produce an air jet directed transverse to the travel path of the defective closure to thereby blow the same off belt 800 and into the entrance of discharge chute 812 for gravity delivery to a scrap container or conveyor belt (not shown) positioned below the outlet 816 of chute 812. Another blow off unit 818 is positioned across belt run 806 from the inlet of a secondary reject discharge chute 820 for blow-off of any defective closure/liner assembly when sensed by a second sensor (not shown) checking for another defect parameter, such as missing liner 192. These two types of defective cap/liner assemblies are then segregated so they can be moved easily and economically recycled.

Closure liner assemblies carried on belt 806 that successfully pass inspection exit conveyor belt below a photoelectric sensor unit 822, which functions as a counter and output detector, and then enter the inlet of a product outlet chute 824 for gravity discharge to a suitable product receiver, such as a container. Preferably outlet chute 824 is pivotally mounted for swinging between two discharge positions (shown in solid and phantom in FIG. 3) as actuated by a rotary-actuator unit 826 on which the inlet end of chute 824 is mounted as shown in FIG. 4. Thus, when the output counter determines that product-receiving a container registered with one of the two chute discharge positions has been filled with the appropriate quantity of liner-closure assemblies, chute 824 is swung to its other discharge position over an adjacent container so that product discharge can continue while the filled container is removed and replaced with an empty container. The support frame work 828 for the foregoing mechanism of discharge conveyor 120 is constructed and arranged as shown in FIGS. 1 and 4.

Operation Of Machine 100

In the operation of machine 100 in performing the method of the invention, it will be seen that from the foregoing description that knife roll 150, anvil 152, and the feed of web 160 of liner material by the upper and lower nip roll assemblies 154,156, efficiently perform the method described in conjunction with FIGS. 20–24A for obtaining web pull back to thereby optimize the number of liner cut-outs obtained from the lanes 1–5 of web 160 as shown in FIG. 34. Yet this closely nested pattern of liner cut-outs in the web is achieved with continuous unidirectional rotary motion of knife roll 150 at a constant speed as it sequentially presents alternating cross-rows of two and three cutting elements 190 to web 160 the latter passes between roll 450 and anvil 152. As the cutting elements of each cross-row are carried away from the web during further roll rotation (counter-clockwise as viewed in FIG. 1) each cut liner 192 is securely held both frictionally and by vacuum within the confines of the circular cutter knife 316 of each associated element 190. The web pullback concept takes advantage of the desirable wide clearance space made available in the non-contact zone between successive cross-rows of die elements that allows web 160 to be pulled back the appropriate predetermined distance in accordance with the method described in conjunction with FIGS. 20–24. The rapid, precise and efficient web feed provided by the computer controlled, servo-motor-driven nip roll assemblies 154 and 156 enables web 160 to be fed forward again in accurate timed relation to match the web speed to that of the next cross-row set of die elements 190 as they engage the web to make the next nested set of liner cut-outs.

As the cutting elements 190 penetrate web 160 to cut-out liners 192 in the cut-out pattern shown in FIG. 34, the cut web material liner 192 is engaged within the confines of the knife edge 316 and sucked inwardly by the suction applied through die element ports 322 from the aforementioned vacuum supply and timing system described in detail in conjunction with FIGS. 8–12 and 15–17. As each cross-row of die elements 190 reach tangency in their travel path with the travel path of the corresponding cross-row of transfer posts 200 at the knife die discharge station, a positive pressure is precisely applied to the interior of the cutting die in conjunction with the negative pressure precisely applied to the upper end of the meeting transfer post by the manifold timing systems as described in detail with respect to rotary knife die assembly 150 and transfer roll sub-assembly 114. This insures rapid, accurate and non-circumferential-slip transfer of each cut liner from cutting die element 190 securely onto the upper end seat of transfer post 200 as shown in FIG. 28.

In addition, the compound spring-biased telescopic motion of post sleeve 494 and outer post 492 of transfer post 200 enables the outer pick-off end of the post to actually enter the confines of the circular knife edge 316 to effect a positive compression of quad seal 522 against the cut liner 192 as vacuum is being applied to the surface of the liner pressed against the post end seat. This combined penetrating and vacuum sucking post action, coupled with the positive die blow off exerted beneath the liner through the die posts 322 ensures a secure positive and arcuate placement of the cut liner 192 onto the transfer post. The continued application of vacuum to the underside of liner 192 in the zone bounded by seal 522 effects a strong clinging action of the liner onto the post end seating surface so that the liner is reliable carried on the post in its travel from the nine o'clock die discharge station position shown in FIG. 1 to the approximately 4 o'clock position. The post then begins to insert the carried liner 192 into the inverted closure cap 194 at the outlet of escapement 124, as described in detail hereinabove in conjunction with the feed chute 130 and escapement mechanism 124 with reference to FIGS. 29–33, while subsequently and at the same time during its convergent travel over presser shoe 122 the post is temporarily installing the cap on the post as it assembles the liner therein.

As each cross-row of transfer posts engages the associated row of closures at the outlet of the escapement during travel in the path TP (FIG. 32), the outer end of the transfer post converges with the closure slidably on apron 730 and shoe 734 to thereby telescope the post into the interior of the closure. During this travel on the shoe the upper open edge of the closure engages bevel 494 of sleeve 494 and forces it to retract on outer post 492 against the force of springs 592. This action assists in centering the closure on the axis of the transfer post and likewise as to the associated cut liner 192 being thereby inserted into the closure. The spring pressure in the telescopically compressible compound sleeves of transfer post thus mechanically assists insertion of the liner to the bottom of the closure. Also, vacuum is cut-off to the post once the closure reaches presser shoe 734. Thus, as the cut liner 192 is being inserted into the closure and reaching bottom position therein, the transfer post becomes fully inserted into the closure as the same slides along surface 736 of the presser shoe 734. The concave curvature of surface 736 is designed to maintain proper spacing to achieve this mechanical squeeze pressure between post and shoe as the closure is thus held therebetween and slid along the surface 736 by the post.

When the transfer post travels past the downstream edge 737 of presser shoe 734 into the discharge station of the transfer roll conveyor, the compression restraint of springs 522 in the transfer post is released, thereby causing sleeve 494 to tend to force the closure-liner assembly 192–194 off of the post and onto the upper run 806 of the discharge conveyor 800. This transfer of the closure is assisted by the timed pressure of the post blow-off action described previously in conjunction with FIGS. 26 and 27, as well as the vacuum draw onto conveyor upper run 806 described previously with reference FIGS. 1 and 4. All closures in each cross-row are dropped simultaneously onto the conveyor and then proceed well spaced in single file out through the conveyor inspection section into the discharge chute 824 (unless blown side ways into one or the other of the reject chutes 816, 820).

Advantages

From the foregoing description and with reference to the accompanying scaled engineering drawings, it will now be fully apparent to those skilled in the art that the web cutting method of the invention as well as the liner-to-closure assembly method of the invention, as practiced by the improved machine 100 of the invention, amply fulfills the aforestated objects and the accomplishes the advantages set forth both hereinabove and hereinafter.

Web utilization is maximized in a simple, efficient and easily programmed manner by utilizing the servo motors to reverse and pull the web back slightly during the period when no cutting is occurring. The servo motors then reverse again to drive the web forward and at the same velocity as the cutting roll elements. The first reversal, pullback, second reversal and speed match is done during the time when the web is not being processed (i.e., in between cuts). While the web is being repeatedly cut and pulled back, the die rolls and other processing rolls are in continuous motion at a constant velocity.

The "web pull back" concept of the invention makes it feasible to use faster, lower cost rotary processing for these type of parts. The cutting elements on the die are located to exactly match the post spacing and lane alignment on the subsequent processing roll and escapement. Thus, all transfers are made positively and without relative motion (i.e., circumferential slip) between cut part and processing rolls. The web feed is accurately and automatically controlled by servo driven nip rolls positioned both before and after the cutting die. The cutting die is manufactured with a predetermined gap between cutting elements (i.e., an area where no cutting occurs and the web is not compressed between the dies or between the die and anvil rolls.) Indeed, this gap enables wider circumferential spacing of die elements on the knife roll and thus facilitates die installation and removal for service and part processing changeover, as well as accommodating a greater variety of die configurations without crowding, and without thereby decreasing processing efficiency.

A further benefit of this invention is that cutting die rolls (cylinders) can be of a constant diameter while cutting parts of varying size. In the past, the diameter of the cutting cylinders would change depending on the size and repeat lengths of the part being cut. With this new system, a single design can be used for varying finished part sizes. This means that all machine parts are completely interchangeable, thus minimizing the number of change parts required to convert the machine from one finished part size to another. Fewer purchased parts means additional savings to the machine user including the fact that less time and effort will be required to effect the changeover.

The method of feeding caps utilizes an improved side-to-side oscillating escapement assembly co-operable with an alternating transfer post layout design. This further allows maximum web utilization since a full row of posts would require excessive side spacing in order to allow for cap wall and guide thicknesses.

The system of the invention can easily process different liner materials and different cap depths through simple adjustments. As long as the cap and liner diameters stay the same, no change parts are required. The system also can place liners into the cap at any depth (fully seated or only partially inserted) and with or without glue application. The extent of post travel while carrying liner inserts provided by the transfer roll conveyor can readily accommodate addition of an automatic glue equipment station, a printing station, etc.

Machine 100 of the invention employs continuous motion, constant velocity, rotary processing principles for all the part handing rolls, which is made possible by the unique "web pullback" feature of the invention so that web utilization is maximized. At the same time, cut liners are spaced properly onto inserter posts such that no "relative motion" (circumferential slip) is required between cutting and transfer rolls at any point. Stated differently, the unique "web pullback" design eliminates the need for "cut and slip" operations when transferring the cut part from one roll to another, and is compatible with a large range of cut part sizes.

Because of the continuous rotary motion design, machine 100 runs at a faster rate than those of intermittent motion design. Thus, this one machine of the invention is now capable of handling the entire output of a single or multiple molding machine(s). By placing this new machine next to the molding equipment, the closures are discharged from the combined machines as finished products which can be taken directly to shipping. No separate machine operations are required. This translates to a direct savings to the manufacturing company since there is no work in process, no extra inventorying and no need for the extra floor space and labor costs associated with a separate department. Alternatively, this higher speed machine 100 can replace multiple units of previous design when used in a "stand alone" or separate department configuration. Further, changeover time for this new machine is in the range of minutes rather than hours, as required for prior machines. Lastly, machine 100 is more "forgiving" relative to cutting method. It is uses the proven "crush cut" or "shear cut" systems of rotary dies which are easier to set up in order to achieve acceptable cut quality. Moreover, cutting is not limited as to type. Rotary shear (male/female), "crush" and other types of cutting can be used as long as the cutting elements are spaced apart to accommodate the "pullback" feature.

The web does not necessarily have to be pulled back by the servo nip system. As described in more detail hereafter with reference to FIG. 37, it is possible to mount the servo motors in a framework which is driven back and forth by a cam arrangement. In this case, the servo motors feed a small amount of material and stop rather than reverse. The pullback and speed matching during the cut would be effected by the cam and frame arrangement.

It is also to be understood that web feed and pullback could be accomplished by all mechanical drives. Additionally, there are many variations in types of materials and products which could be processed by this method. It is not limited to insertion of liners into molded closures. Likewise, a roll orientation, web feed orientation, numbers of rolls, processing steps, etc. could all vary while still emplaying the pullback principle.

For closure liners, there are many variations of size, style and material. The same is true of the closures. Also, there are many variations of glue types, applicators and methods of activating. It will now be appreciated that the method and machine of the invention is readily adaptable to handle such variations without losing its aforementioned primary advantages.

Alternate Embodiment Shuttle System For Web Pullback

Figure 37:
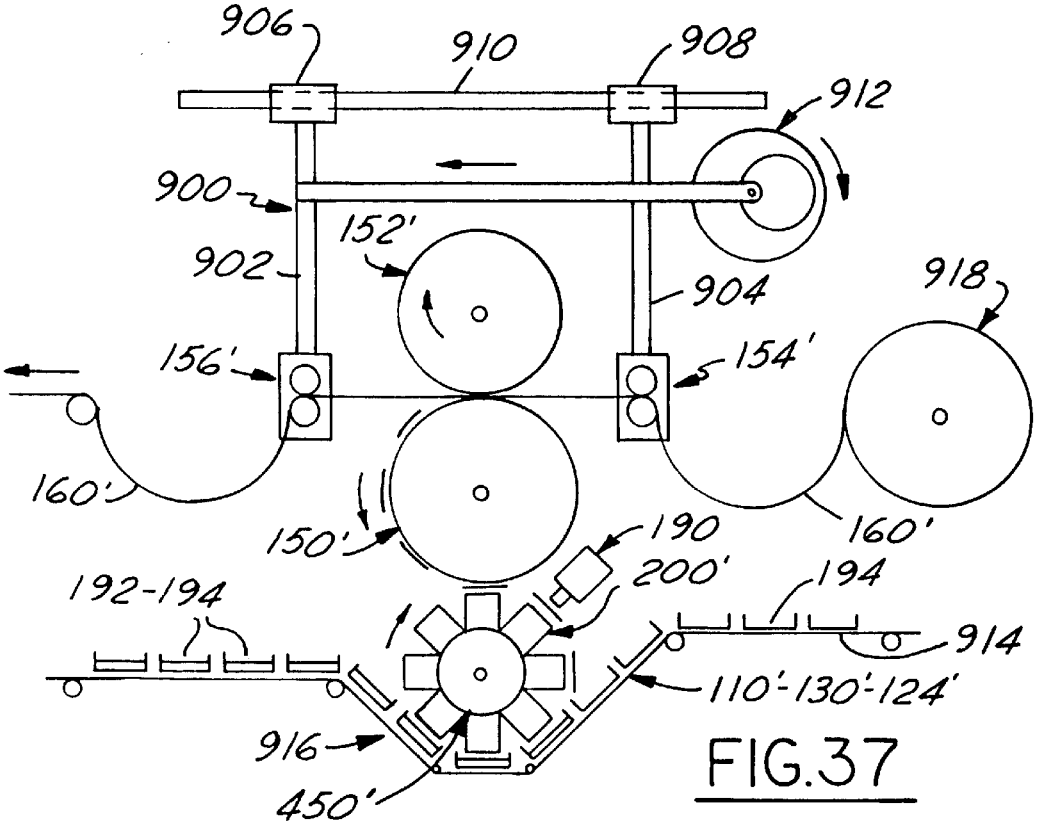
FIG. 37 is a diagrammatic view of an alternate embodiment of a machine and method of the invention.

As illustrated diagrammatically in FIG. 37, an alternate method and machine organization is also provided, in accordance with the method and apparatus of the present invention. The system illustrated in FIG. 37 provides a mechanical shuttle system in order to provide a positive speed match between a web 160' and die roll 150'. This system employs a framework 900 comprising a pair of struts 902 and 904 suspended on linear ball bushings 906, 908 from a stationary support track 910. Frame 900 carries both sets of nip roll assemblies 154', 156', at the lower end of struts 904 and 902 respectively. The drive for imparting reciprocation motion of frame 900 comprises a rotating cam mechanism 912 of conventional construction but mechanically linked or otherwise timed to motion of die roll 150' so that forward motion of frame 900 exactly matches the speed of web 160' to the surface speed of die 150' at the die cutting convergence zone of die roll 150', web 160' anvil roll 152', and while the nip rolls of the infeed and ouffeed nip rolls assemblies 154', 156' are stopped. The total throw of the cam is made greater than the distance of one cut.

When the blades of the cutting die elements on rotary knife roll 150' are clear of web 160', frame 900 moves backwards to repeat the cycle. Again, nip rolls of feeders 154', 156' are stopped during web cutting, then are started and operated to feed a slight amount of web material 160' in the forward direction, during the time when the shuttle frame 900 is retracting.

Preferably, shuttle frame 900 is designed to be rigid but light weight. Preferably shuttle cam 912 is designed to accommodate a diametrical range of cut liner sizes 38 mm down to 20 mm without the need to change the cam. Additionally, sufficient dwell, acceleration and deceleration allowance should be provided in the cam design to ensure proper operation and timing of the nip roll drive in the nip roll assemblies 154', 156'. Die roll 150' preferably is constructed similar to die roll 150 with vacuum hold-on of cut liners in the cutting die elements after being severed from web 160', and the cutting die element pattern array is a non-interlocked pattern similar to that of knife die roll 150.

A rotary transfer post roll 450' is also provided in the system of FIG. 37 with blow-off and vacuum transfer of cut liners from rotary knife die 150' onto the associated transfer posts of transfer roll 450'. A closure feeding system provides a line of oriented and inverted closures 194 from a sorter on a conveyor mechanism 914 provided with a gravity feed chute and shuttle loading system 110'–130', 124'. A blow-off transfer roll discharge station for completed closure-liner assemblies is provided at the location indicated at 916. Finished liner-closure assemblies 192–194 are then conveyed as indicated diagrammatically for inspection and packing into a bulk shipping container. Alternatively, the system of FIG. 37 can be used with a feed assembly system as described previously hereinabove with reference to FIGS. 29–33.

Additionally, a conventional web supply roll mechanism 918 is provided, preferably of the independent roll unwind type, i.e. the feed of web 160' from row 918 would start and stop depending on the free loop size between roll 918 and nip roll assembly 154'. Also, a suitable automatic material application unit 920 maybe provided at the position indicated in the travel of cut liners on transfer post 200' of roll 450'. Unit 920 maybe an intaglio printing unit for labeling cut liners while carried on the transfer post, or a hot melt adhesive gun for applying adhesive directly onto the liner exposed surface prior to insertion of the same into the closure 194.

Preferably, the nip roll feeder 154' is provided with the servo drive of the type described in conjunction with machine 100, and the servo drive is operated so that the nip rolls of feeder 154' and 156' are stopped on forward motion on frame 900 and then operated conjointly to play out approximately 1 half index of material while frame 900 is moving backwards. The outfeed nip roll feeder 156' is preferably also provided with a servo drive which is slaved to servo drive the infeed feeder 154'.

It is claimed:

1. A method of repetitively making products continuously from web material utilizing a rotary carrier having an array of web working implements supported thereon for bodily travel in a rotary path about a rotational axis of the carrier, an anvil having a web supporting surface operable to move in a path tangentially adjacent the path of travel of the carrier-supported web working implements and in their travel direction to thereby define a convergent web working zone therebetween, and utilizing a web feeder for feeding the web material lengthwise linearly between the web supporting surface of the anvil and the implement travel path through the convergent web working zone therebetween, said method comprising the steps of:

(a) constructing and arranging the web working implements on the rotary carrier so as to have a cylindrical pattern array thereon with predetermined spacing between individual implements circumferentially of the cylindrical pattern array which would produce a corresponding linearly spaced first rollout web working pattern when web feed speed and direction continuously matches that of the implements in the web working zone, (b) continuously unidirectionally rotating the rotary carrier at a constant angular velocity, (c) operating the web feeder to;

(1) advance the web in a linear travel path through the work zone such that the web travel speed and direction matches that of a given first implement as it passes through the work zone and the web travel path to thereby cause the first implement to form a corresponding product on the web, (2) then retract the web a given pullback distance, less than that of the circumferential spacing distance between the first implement and a next successive second implement on the carrier, when the first implement travels clear of the web travel path and before the second implement enters the web travel path, (3) and then resume advance of the web such that the web travel speed and direction matches that of the second implement as it passes through the work zone and the web travel path to thereby cause the second implement to form a corresponding product on the web, and (d) then repeating step (c) throughout the travel of a succeeding carrier implement array through the work zone and web travel path during each revolution of the carrier to thereby form a correspondingly linearly spaced second rollout web working pattern of products produced on the web having interproduct spacing lengthwise of the web less than that of the first rollout web working pattern.

2. The method of claim 1 wherein step (a) further comprises arranging the web working implements on the carrier to form first and second lanes of the implements extending circumferentially 360° in the cylindrical pattern array, and wherein the implements are constructed and arranged in the lanes such that the rotary travel path of first lane implements overlaps that of the second lane implements transversely of their travel paths and such that the second rollout pattern of products produced on the web are arrayed internested laterally in the web and in first and second web lanes respectively aligned with the first and second implement lanes but without interference between individual products thereby produced on the web.

3. The method of claim 2 wherein step (a) further comprises providing the web working implements in the form of web cutters operable in step (c) to sever from the material of the web each associated product produced on the web.

4. The method of claim 3 comprising the further step of applying vacuum to each cutter as it engages the web to thereby vacuum draw the associated web cut product against the cutter as it is being severed from the web by the cutter to thereby pick-off and transport the cut product on the cutter and away from the web travel path.

5. The method of claim 4 wherein the vacuum is maintained on the cutter after product severance and pick-off and during product transport travel of the cutter to a discharge station located adjacent the carrier cutter travel path remote from the web travel path, and then applying positive air pressure to the cutter when it travels past the discharge station to blow-off the product being transported thereon.

6. The method of claim 5 further comprising the steps of:

(e) providing a transfer conveyor having an array of transfer posts constructed and arranged in lanes corresponding to those of the cutters on the carrier for travel into and out of individual registry sequentially with the cutters in their travel lanes on the carrier as they travel through the carrier discharge station and with the posts then moving at the same speed of travel as the cutters, each post having a product pick-off end receiver operable for engaging the cut product on the associated cutter during such registry, and (f) applying vacuum air pressure to the transfer post receiver such that it is operable to thereby draw-assist pick off the cut product from the cutter and onto the post receiver for transport travel of the product on the post to a transfer conveyor discharge station located remote from the carrier discharge station.

7. The method of claim 6 comprising the further step of: (g) sorting out products being transported on the transfer conveyors respectively cut from the first and second web lanes by providing side-by-side first and second cut product receivers and operating the receivers through a cycle in which the first receiver is positioned initially in alignment with a transfer post traveling in the first lane when the first lane cut product carried thereon enters the conveyor discharge station, transferring the first lane cut product from the first lane transfer post into the first receiver during travel of the first lane transfer post therepast, then shifting the receivers in a shift path perpendicular to the travel path of the conveyor posts to thereby position the second receiver in alignment with a transfer post traveling in the second lane when the second lane cut product thereon enters the conveyor discharge station, transferring the second lane cut product from the second lane transfer post onto the second receiver during travel of the second lane post therepast, then shifting back the receivers in the shift path to bring the first receiver back to its initial alignment with the first lane ready for the transfer of a cut product from the next successive first lane post to thereby complete one of the sorting cycles.

8. The method of claim 7 wherein each receiver comprises a closure cap oriented with an open end facing the post end receiver of the associated transfer post as it approaches the associated cap in its associated receiving position in the shift cycle path, and wherein each of the cut products comprises a cap liner produced from the web to match the associated cap, and wherein the post-to-cap transfer step is operable to cause insertion of the liner into the cap.

9. A method of repetitively making products continuously from web material utilizing a rotary carrier having a web working implement supported thereon for bodily travel in a rotary path about a rotational axis of the carrier, an anvil having a web supporting surface operable to move in a path tangentially adjacent the path of travel of the carrier-supported web working implement and in its travel direction to thereby define a convergent web working zone therebetween, and utilizing a web feeder for feeding the web material lengthwise linearly between the web supporting surface of the anvil and the implement travel path through the convergent web working zone therebetween, said method comprising the steps of:

(a) constructing and arranging the web working implements on the rotary carrier so as to have a cylindrical spacing pattern thereon with predetermined spacing on the carrier between the leading and trailing ends of the implement circumferentially of the cylindrical pattern which would produce a correspondingly linearly spaced first rollout web working pattern when web feed speed and direction continuously matches that of the implement in the web working zone, (b) continuously unidirectionally rotating the rotary carrier at a constant angular velocity, (c) operating the web feeder to;

(1) advance the web in a linear travel path through the work zone such that the web travel speed and direction matches that of the implement as it passes through the work zone and the web travel path to thereby cause the first implement to form a corresponding product on the web, (2) then retract the web a given pullback distance less than that of the circumferential spacing distance between the space occupied by the implement on the carrier, such retraction occurring when the implement is traveling clear of the web travel path, (3) and then resume advance of the web such that the web travel speed and direction matches that of the implement as it again passes through the work zone and the web travel path to thereby cause the implement to form a corresponding product on the web, and (d) then repeating step (c) throughout the travel of the implement through the work zone and web travel path during each revolution of the carrier to thereby form a correspondingly linearly spaced second rollout web working pattern of products produced on the web having interproduct spacing lengthwise of the web less than that of the circumferential spacing distance between the space occupied by the carrier implement and hence less than that of the first pattern.

10. Apparatus for repetitively making products continuously from web material comprising, in combination, a rotary carrier having an array of web working implements supported thereon for bodily travel in a rotary path about a rotational axis of the carrier, an anvil having a web supporting surface operable to move in a path tangentially adjacent the path of travel of said carrier implements and in their travel direction to thereby define a convergent web working zone therebetween, and a feeder for feeding a web material lengthwise linearly between the anvil web supporting surface and the implement travel path through the convergent work zone therebetween, said web working implements being constructed and arranged on said rotary carrier so as to have a cylindrical pattern array thereon with predetermined spacing individually between said implements circumferentially of the cylindrical pattern array which would produce a correspondingly linearly spaced first rollout web working pattern when web feed speed and direction continuously matches that of the implements in the web working zone, drive means for continuously unidirectionally rotating said rotary carrier at a constant angular velocity, and control means operably coupled to said feeder for operating said web feeder to;

(a) advance the web in a linear travel path through the work zone such that the web travel speed and direction matches that of a given first implement as it passes through the work zone and the web travel path to thereby cause the first implement to form a corresponding product on the web, (b) then retract the web a given pullback distance less than that of the circumferential spacing distance between the first implement and a next successive second implement on the carrier when the first implement travels clear of the web travel path and before the second implement enters the web travel path, (c) and then resume advance of the web such that the web travel speed and direction matches that of the second implement as it passes through the work zone and the web travel path to thereby cause the second implement to form a corresponding product on the web, and (d) then repeating the cycle of (a), (b) and (c) throughout the travel of succeeding implements in said carrier implement array through the work zone and web travel path during each revolution of the carrier to thereby form a condensed second rollout web working pattern of products produced on the web having interproduct spacing lengthwise of the web less than that of the first rollout web working pattern.

11. The apparatus of claim 10 wherein said web working implements are arranged on said carrier to form first and second lanes of said implements extending circumferentially 360° in the cylindrical pattern array, and wherein said implements are constructed and arranged in the carrier lanes such that the rotary travel path of said first lane implements overlaps that of said second lane implements transversely of their travel paths and such that the second rollout pattern of products produced on the web are arrayed laterally internested in the web and in first and second web lanes respectively aligned with the first and second implement carrier lanes but without interference between individual products thereby produced on the web.

12. The apparatus of claim 11 wherein said web working implements are in the form of web cutters operable in the web working zone to sever from the material of the web each associated product produced on the web.

13. The apparatus of claim 12 further including pressurized air supply means constructed and for applying vacuum to each said cutter as it engages the web to thereby vacuum draw the associated web cut product against said cutter as it is being severed from said web by the cutter to thereby pick-off and transport the cut product on said cutter and away from the web travel path.

14. The apparatus of claim 13 wherein said pressurized air supply means is constructed and arranged to maintain application of the vacuum on said cutter after the product severance and pick-off and during product transport travel of the cutter to a discharge station located adjacent the carrier cutter travel path remote from the web travel path, and then to apply positive air pressure to said cutter when it travels past the discharge station to blow-off the product being transported thereon.

15. The apparatus of claim 14 further comprising, in combination therewith, a transfer conveyor having an array of transfer posts constructed and arranged in lanes corresponding to those of said cutters on said carrier for travel into and out of individual registry and sequentially with said cutters in their travel lanes on said carrier as they travel through the carrier discharge station and with said posts then moving at the same speed of travel as said cutters, each said post having a product pick-off end receiver operable for engaging the cut product on an associated one of said cutters during such registry, vacuum supply means constructed and arranged to apply vacuum air pressure to each said transfer post receiver such that it is operable to thereby draw-assist pick off of the cut product from the cutter and onto the post receiver for transport travel of the product on such post to a transfer conveyor discharge station located remote from the carrier discharge station, and pressurized air supply means constructed and arranged to apply positive air pressure to each said transfer post receiver when registered with the transfer conveyor discharge station for causing blow-off thereat of the product from such post.

16. The apparatus of claim 15 further comprising, in combination therewith, an escapement for receiving from said transfer conveyor cut products being transported thereon and respectively cut from the first and second web lanes, said escapement being constructed and arranged to include side-by-side first and second cut product receivers and actuating means for operating said receivers through a cycle in which;

(a) said first receiver is positioned initially in alignment with a first said transfer post traveling in the first transfer conveyor lane when the first lane cut product carried thereon enters the conveyor discharge station for transfer of the first lane cut product from said first transfer conveyor lane transfer post into said first receiver;

(b) then said receivers are shifted in a shift path perpendicular to the travel path of said conveyor posts to thereby position said second receiver in alignment with a second said transfer post traveling in the second conveyor lane when the second lane cut product thereon enters the conveyor discharge station for transfer of the second lane cut product from said second transfer post onto said second receiver; and (c) then the receivers are shifted back in the shift path to bring said first receiver back to its initial position in alignment with the conveyor first lane ready for the transfer of a cut product from the next successive one of said first lane posts to thereby complete one of the cycles.

17. The apparatus of claim 16 wherein each of said receivers of said escapement is constructed and arranged to supply and position closure caps oriented with an open end facing the end receiver of each said associated transfer post as it approaches the associated cap in its associated receiving position in the shift cycle path, wherein each of the cut products comprises a cap liner produced from the web to match the associated cap, and wherein said posts and said escapement means are co-operable to effect post-to-cap transfer and insertion of the liner into the cap.

18. The apparatus of claim 17 wherein each said transfer post comprises spring based telescopic engagement means constructed and arranged to yieldably telescopically enter an associated said die cutter at the cutter carrier discharge station to engage a cut liner therein to thereby assist vacuum pick-off of the cut liner and transfer onto said post, and likewise to yieldably telescopically insert the cut liner into an associated said cap at said escapement means to thereby assist the cut liner being blown off said post into said cap.

19. The apparatus of claim 18 wherein said post telescopic engagement means is tapered for guiding entry of said post into said cap open end at said escapement means to assist in registry and centering of said cap for temporary transport of cap and liner assembly on said post downstream of said escapement means.

20. The apparatus of claim 19 wherein a presser shoe is constructed and arranged adjacent and downstream of said escapement for slidably supporting each said cap in a travel path convergent with that of each said transfer post traveling therealong to thereby support the cap as said post engages and telescopically enters such cap to thereby assist insertion of the cut liner therein and telescopically interengage the cap and post.

* * * * *